US007195528B2

(12) United States Patent
Takada et al.

(10) Patent No.: US 7,195,528 B2
(45) Date of Patent: Mar. 27, 2007

(54) OUTBOARD MOTOR EXHAUST SYSTEM

(75) Inventors: Hideaki Takada, Saitama (JP); Hiroshi Mizuguchi, Saitama (JP); Shinsaku Nakayama, Saitama (JP)

(73) Assignee: Honda Motor Co., Ltd, Tokyo (JP)

( * ) Notice: Subject to any disclaimer, the term of this patent is extended or adjusted under 35 U.S.C. 154(b) by 0 days.

(21) Appl. No.: 11/210,475

(22) Filed: Aug. 24, 2005

(65) Prior Publication Data

US 2006/0046586 A1 Mar. 2, 2006

(30) Foreign Application Priority Data

Aug. 31, 2004 (JP) ..... 2004-252574

(51) Int. Cl.
*B63H 21/34* (2006.01)

(52) U.S. Cl. ..... 440/89 G

(58) Field of Classification Search ..... 440/89 G, 440/1, 2, 89 A

See application file for complete search history.

(56) References Cited

U.S. PATENT DOCUMENTS 5,348,500 A * 9/1994 Lassanske ..... 440/89 R
5,954,554 A * 9/1999 Bates ..... 440/89 R
6,299,496 B1 * 10/2001 Griffiths et al. ..... 440/89 R

FOREIGN PATENT DOCUMENTS

JP 07-144693 6/1995

* cited by examiner

*Primary Examiner*—Ed Swinehart
(74) *Attorney, Agent, or Firm*—Carrier, Blackman & Associates, P.C.; Joseph P. Carrier; William D. Blackman

(57) ABSTRACT

In an outboard motor exhaust system having a first exhaust gas passage discharging engine exhaust gas into water and a shift actuator operating a shift mechanism to establish one from among a forward position, a reverse position and a neutral position, there are provided a second exhaust gas passage branched from the first exhaust gas passage at a location above the water and an exhaust valve installed in the second exhaust gas passage and connected to the shift mechanism to be opened when the reverse position is established. The exhaust valve is alternatively opened by an exhaust valve actuator installed separately from the shift actuator. With this, it becomes possible to prevent the decrease in thrust produced during reverse boat travel by the engine exhaust gas being sucked in by a propeller, without degrading shift feel.

14 Claims, 21 Drawing Sheets

OUTBOARD MOTOR EXHAUST SYSTEM

BACKGROUND OF THE INVENTION

1. Field of the Invention

This invention relates to an outboard motor exhaust system.

2. Description of the Related Art

In outboard motors incorporating an internal combustion engine used as a power source for driving a propeller, the exhaust gas generated by the engine is generally passed through the boss portion of the propeller to be discharged rearward into the water. However, when engine exhaust gas is discharged into the water rearward of the propeller, it is drawn in by the propeller when the shift position is reverse and the boat moves rearward. This is disadvantageous because it decreases thrust.

In order to solve this problem, Japanese Laid-Open Patent Application No. Hei 7(1995)-144693 teaches a configuration which during reverse boat travel discharges the exhaust gas into the atmosphere (outside air) through an exhaust gas passage provided above the water level of the outboard motor. The exhaust gas passage is provided midway with an exhaust valve mechanically linked with the outboard motor shift mechanism. When the shift mechanism establishes the reverse gear, the exhaust valve is opened via the linkage.

In the conventional outboard motor, shift position is changed by the operator manually operating a shift lever mechanically linked with the shift mechanism. Therefore, the configuration of '693, which interlocks the exhaust valve opening operation with the shift mechanism operation, has a problem in that it increases the manipulation load of the shift lever, thereby degrading the shift feel.

SUMMARY OF THE INVENTION

An object of the invention is therefore to overcome this problem by providing an outboard motor exhaust system that prevents the decrease in thrust produced during reverse boat travel by engine exhaust gas being sucked in by the propeller, without degrading shift feel.

In order to achieve the object, there is provided an exhaust system of an outboard motor adapted to be mounted on a stern of a boat and having an internal combustion engine to power a propeller and a first exhaust gas passage which discharges exhaust gas generated by the engine into water in which the boat is situated, comprising: a shift actuator operating a shift mechanism to establish one from among a forward position, a reverse position and a neutral position; a second exhaust gas passage branched from the first exhaust gas passage at a location above the water; and an exhaust valve installed in the second exhaust gas passage and connected to the shift mechanism to be opened when the reverse position is established.

BRIEF DESCRIPTION OF THE DRAWINGS

The above and other objects and advantages of the invention will be more apparent from the following description and drawings in which.

DETAILED DESCRIPTION OF THE PREFERRED EMBODIMENTS

Embodiments of an outboard motor exhaust system according to the present invention will now be explained with reference to the attached drawings.

Figure 1:
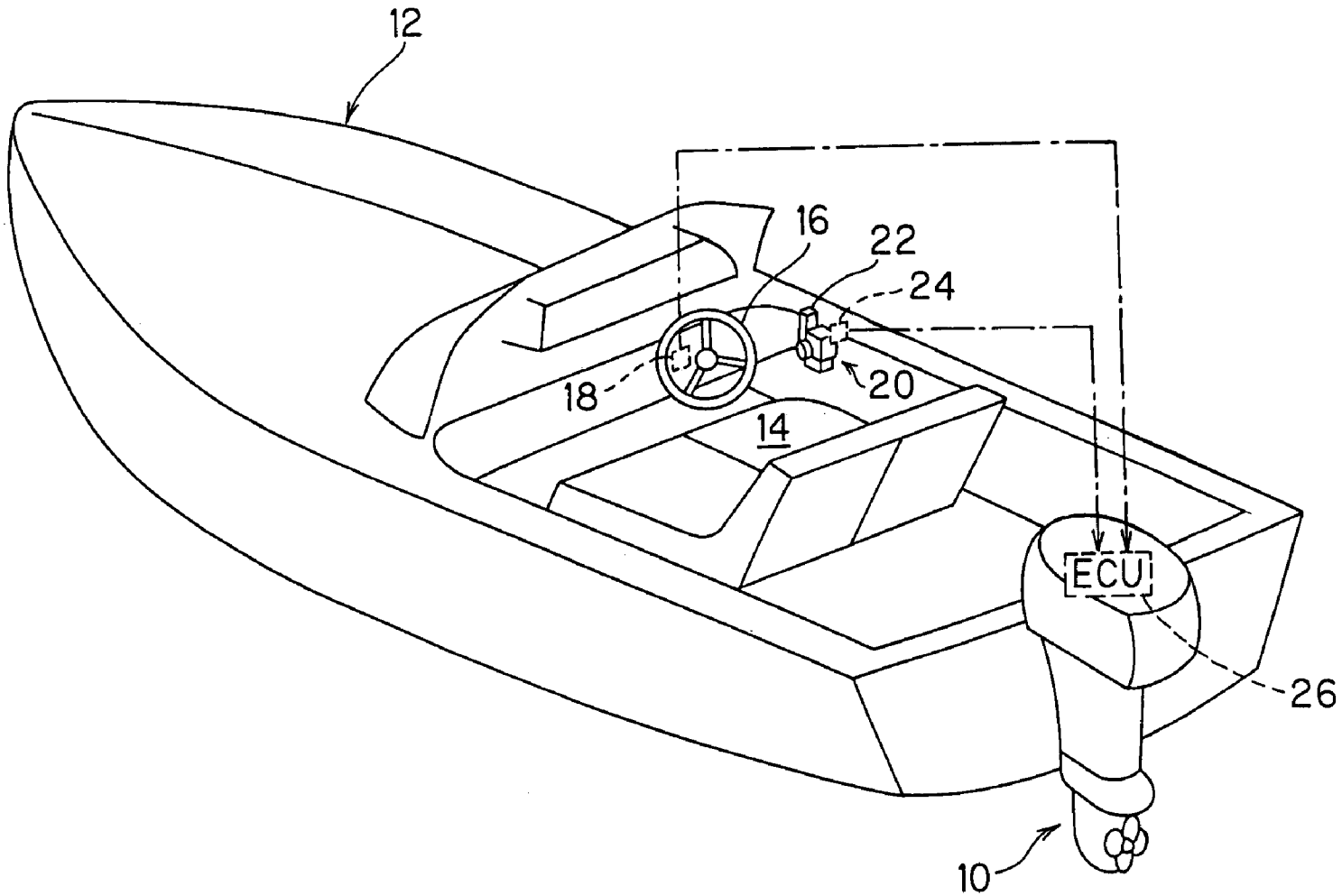
FIG. 1 is an overall schematic view of an outboard motor exhaust system including a boat (hull) according to a first embodiment of this invention.
Figure 2:
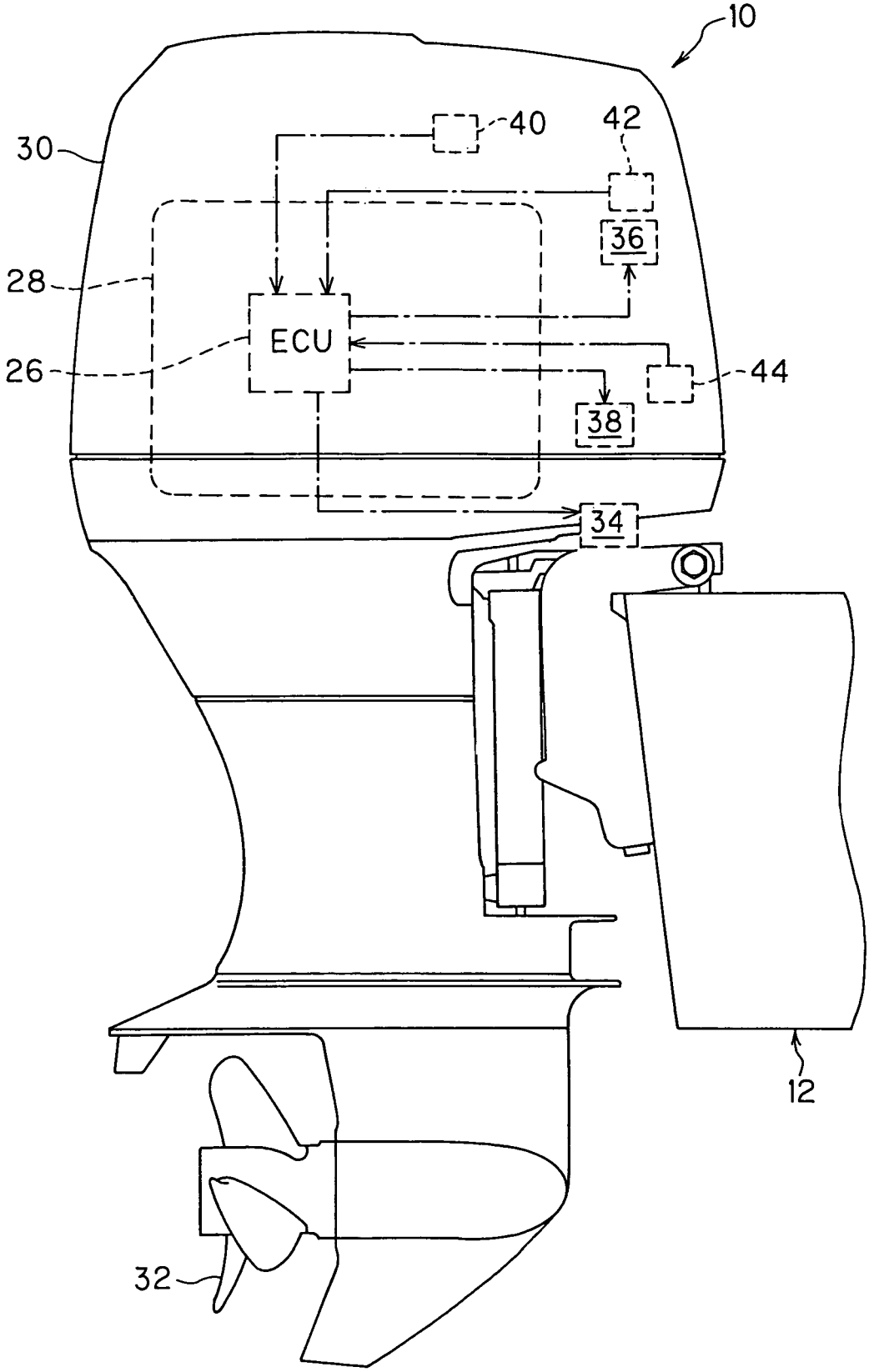
FIG. 2 is a side view of the outboard motor shown in FIG. 1.

FIG. 1 is an overall schematic view of an outboard motor exhaust system including a boat (hull) according to a first embodiment of the invention and FIG. 2 is a side view of the outboard motor shown in FIG. 1.

In FIGS. 1 and 2, the symbol 10 indicates an outboard motor. The outboard motor 10 is mounted on the stern (transom) of a boat (hull) 12.

As shown in FIG. 1, a steering wheel 16 is installed near a cockpit (the operator's seat) 14 of the boat 12. A steering wheel angle sensor 18 is installed near a shaft (not shown) of the steering wheel 16 and outputs or generates a signal indicative of the steering angle (rotation amount of the steering wheel 16) manipulated by the operator. A remote control box 20 is installed near the cockpit 14. The remote control box 20 is installed with an operation lever (device) 22 that can be freely manipulated by the operator, and a lever position sensor 24 that outputs or generates signals in response to a position of the operation lever 22, more specifically, a direction in which the operation lever 22 is manipulated and an amount of manipulation thereof.

The outputs from the steering wheel angle sensor 18 and lever position sensor 24 are sent to an electronic control unit (hereinafter referred to as "ECU") 26 mounted on the outboard motor 10. The ECU 26 comprises a microcomputer.

As shown in FIG. 2, the outboard motor 10 is equipped with an internal combustion engine (hereinafter referred to as "engine") 28 at its upper portion. The engine 28 is a spark-ignition gasoline engine. The engine 28 is located above the water surface and enclosed by an engine cover 30. The ECU 26 is installed under the engine cover 30 at a location near the engine 28.

The outboard motor 10 is equipped at its lower portion with a propeller 32. The propeller 32 is powered by the engine 28 to operate to propel the boat 12 in the forward and reverse directions.

The outboard motor 10 is further equipped with an electric steering motor (steering actuator) 34 for steering the outboard motor 10 to the right and left directions, an electric throttle motor (throttle actuator) 36 for opening and closing a throttle valve (not shown in FIG. 2) of the engine 28 and an electric shift motor (shift actuator) 38 for operating a shift mechanism (not shown in FIG. 2) to change a shift position.

A crank angle sensor (engine speed detector) 40 is installed near a crankshaft (not shown) of the engine 28. The crank angle sensor 40 outputs or generates a crank angle signal once every predetermined crank angles (e.g., 30 degrees) and the outputs are successively sent to the ECU 26. The ECU 26 detects (calculates) the engine speed NE by counting the outputs from the crank angle sensor 40. A throttle position sensor 42 is installed near the electric throttle motor 36 and outputs or generates a signal indicative of a throttle opening θTH. Further, a shift position sensor 44 is installed near the electric shift motor 38 and outputs or generates a signal indicative of the shift position of the outboard motor 10. The outputs from the throttle opening sensor 42 and shift position sensor 44 are also sent to the ECU 26.

The ECU 26 controls the operation of the electric steering motor 34 based on the outputs from the steering wheel angle sensor 18 to steer the outboard motor 10 to the right and left directions. The ECU 26 further controls the operations of electric throttle motor 36 and electric shift motor 38 based on the outputs from the lever position sensor 24, crank angle sensor 40, throttle opening sensor 42 and shift position sensor 44. The control of the electric throttle motor 36 and electric shift motor 38 will be explained later.

Figure 3:
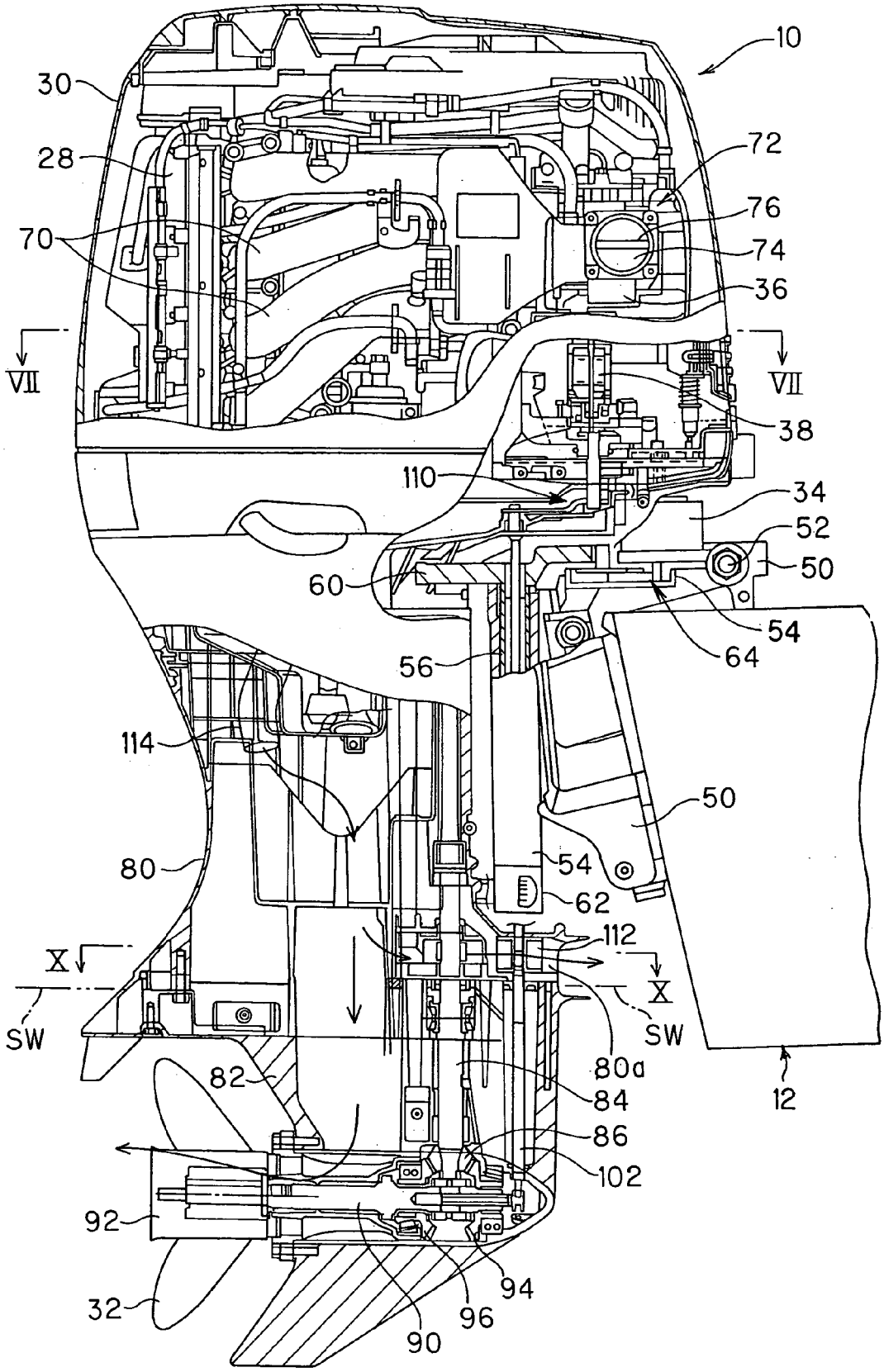
FIG. 3 is a partial sectional view of the outboard motor shown in FIG. 1.

The structure of the outboard motor 10 will now be described in detail with reference to FIG. 3. FIG. 3 is a partial sectional view of the outboard motor 10.

As shown in FIG. 3, the outboard motor 10 is equipped with stern brackets 50 fastened to the stern of the boat 12, such that the outboard motor 10 is mounted on the stern of the boat 12 through the stern brackets. A swivel case 54 is attached to the stern brackets 50 through a tilting shaft 52. A swivel shaft 56 is housed in the swivel case 54 to be freely rotated about a vertical axis. The upper end of the swivel shaft 56 is fastened to a mount frame 60 and the lower end thereof is fastened to a lower mount center housing 62. The mount frame 60 and lower mount center housing 62 are fastened to a frame (not shown) constituting a main body of the outboard motor 10.

The upper portion of the swivel case 54 is installed with the electric steering motor 34. The output shaft of the electric steering motor 34 is connected to the mount frame 60 via a speed reduction gear mechanism 64. Specifically, a rotational output generated by driving the electric steering motor 34 is transmitted via the speed reduction gear mechanism 64 to the mount frame 60 such that the outboard motor 10 is steered (rotated) about the swivel shaft 56 as a rotational axis to the right and left directions (i.e., rotated about the vertical axis).

The engine 28 has an intake pipe or passage 70 that is connected to a throttle body 72. The throttle body 72 has a throttle valve 74 installed therein and the electric throttle motor 36 is integrally disposed thereto. The output shaft of the electric throttle motor 36 is connected via a speed reduction gear mechanism (not shown) installed near the throttle body 72 with a throttle shaft 76 that supports the throttle valve 74. Specifically, a rotational output generated by driving the electric throttle motor 36 is transmitted to the throttle shaft 76 to open and close the throttle valve 74, thereby regulating an air intake amount of the engine 28 to regulate the engine speed NE.

An extension case 80 is installed at the lower portion of the engine cover 30 covering the engine 28 and a gear case 82 is installed at the lower portion of the extension case 80. A drive shaft (a vertical shaft) 84 is rotatably supported to be parallel with the vertical axis inside the extension case 80 and gear case 82. One end (the upper end) of the drive shaft 84 is connected to the crankshaft of the engine 28 and the other end (the lower end) thereof is equipped with a pinion gear 86.

A propeller shaft 90 is rotatably supported to be parallel with a horizontal direction inside the gear case 82. The propeller 32 is attached to the propeller shaft 90 via a boss portion 92.

Figure 4:
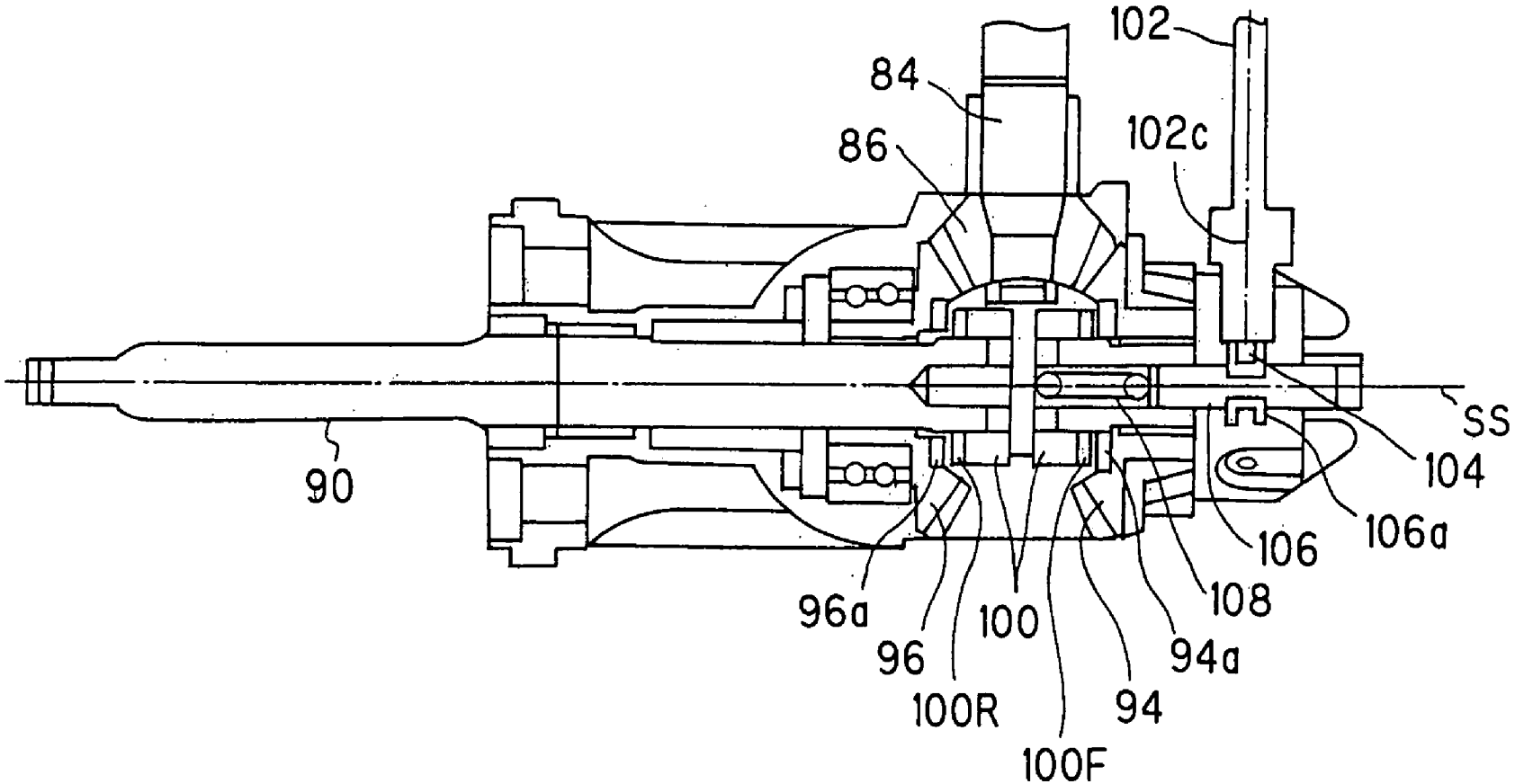
FIG. 4 is an enlarged sectional view of a vicinity of a propeller shaft shown in FIG. 3.

FIG. 4 is an enlarged sectional view of a vicinity of the propeller shaft 90.

As shown in FIG. 4, a forward bevel gear 94 and a reverse bevel gear 96 are rotatably supported on the outer circumference of the propeller shaft 90. The forward gear 94 and reverse gear 96 mesh with the pinion gear 86 installed at the lower end of the drive shaft 84 and rotate in the opposite directions from each other.

A plurality of claws 94*a* and 96*a* are formed on the bevel gears 94 and 96, respectively. A shifter clutch 100 that integrally rotates with the propeller shaft 90 is installed between the forward bevel gear 94 and reverse bevel gear 96. The shifter clutch 100 has a cylindrical shape in which its axial direction is to be the propeller shaft 90. A plurality of claws 100F, which mesh with the claws 94*a*, are formed on one circular surface of the shifter clutch 100 on the side facing the forward bevel gear 94, and a plurality of claws 100R which mesh with the claws 96*a* are formed on the other circular surface thereof on the side facing the reverse bevel gear 94. Specifically, a clutch of meshed type, i.e., a dog clutch comprises the claws 100F, 100R formed on the shifter clutch 100, the claws 94*a* formed on the forward bevel gear 94 and the claws 96*a* formed on the reverse bevel gear 96.

A shift rod 102 is rotatably supported to be parallel with the vertical axis inside the gear case 82. The shift rod 102 is provided with, at its bottom end, a rod pin 104 at a position eccentric to the center axis (indicated by the symbol 102C). The rod pin 104 is inserted in a recess 106*a* formed on a shift slider 106 installed at a location lower than the shift rod 102. The shift slider 106 is connected to the shifter clutch 100 through a spring 108 and is free to slide in a longitudinal axis of the propeller shaft 90 and shifter clutch 100 (indicated by the symbol SS).

The shift mechanism of the outboard motor 10 comprises the above-mentioned gears 94 and 96, shifter clutch 100, shift rod 102, shift slider 106 and spring 108.

It should be noted that the positions of the shifter clutch 100 and rod pin shown in FIG. 4 are those when the shift position is neutral.

When the shift rod 102 is rotated from the neutral position shown in FIG. 4, the rod pin 104 will be displaced along a locus of circular arc whose radius is corresponding to the amount of eccentricity from the center axis 102*c* of the shift rod 102. In other words, in response to the rotation of the shift rod 102, the rod pin 104 displaces in a direction in which the shift slider 106 slides. With this, the shift slider 106 and shifter clutch 100 slide, and the shifter clutch 100 is brought into engagement with the forward bevel gear 94 or the reverse bevel gear 96, or is held at the neutral position.

Figure 5:
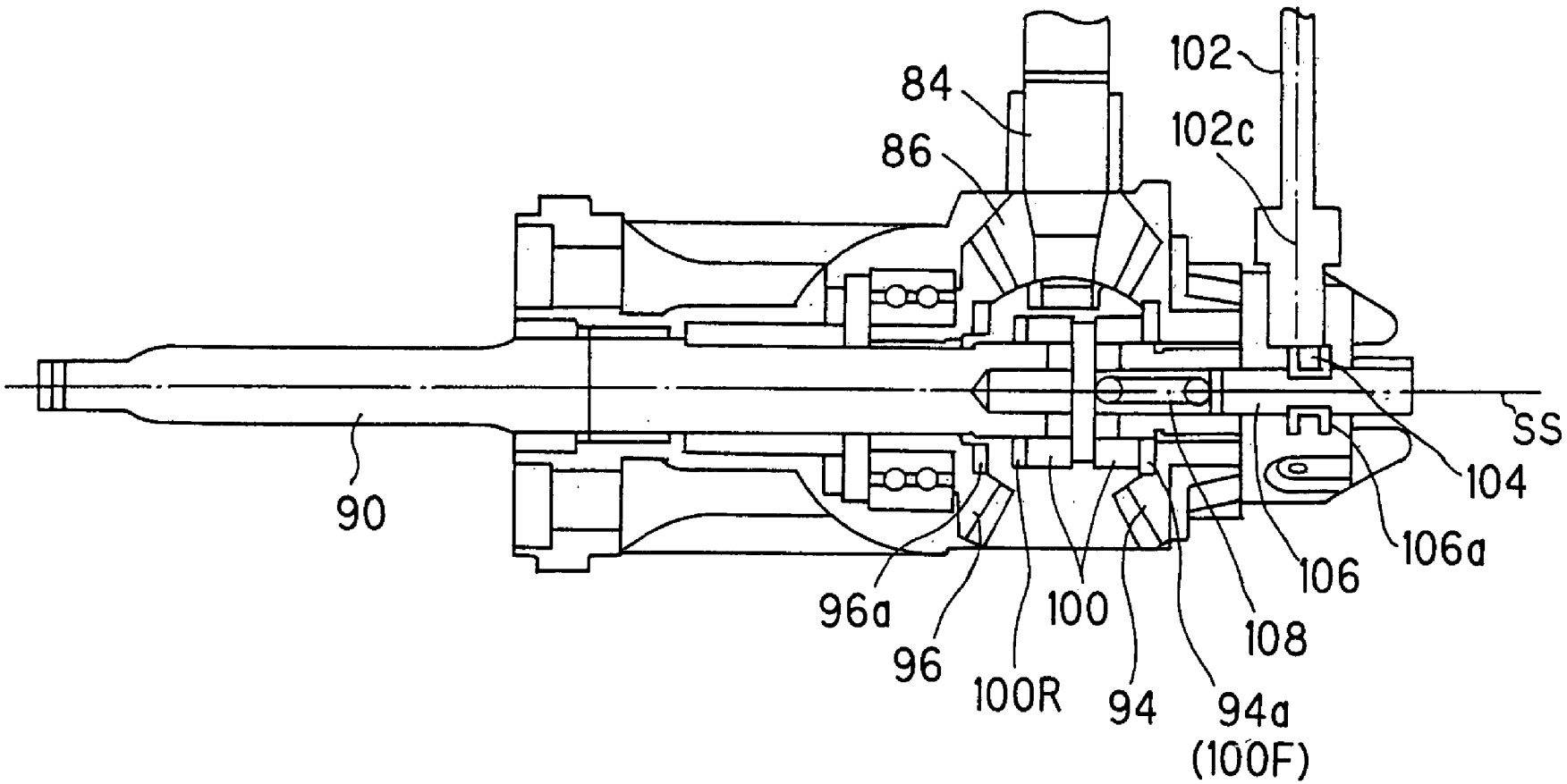
FIG. 5 is an enlarged sectional view of a vicinity of the propeller shaft shown in FIG. 3.

More specifically, when the shift rod 102 is rotated clockwise (viewed from the top) by 45 degrees from the neutral position, the shift slider 106 and shifter clutch 100 slide toward the forward bevel gear 94 as shown in FIG. 5, and the claws 100F formed on the shifter clutch 100 is meshed with the claws 94*a* formed on the forward bevel gear 94. With this, the forward position is established and the rotation of the drive shaft 84 is transmitted through the pinion gear 86 and forward bevel gear 94 to the propeller shaft 90 such that the propeller 32 rotates.

Figure 6:
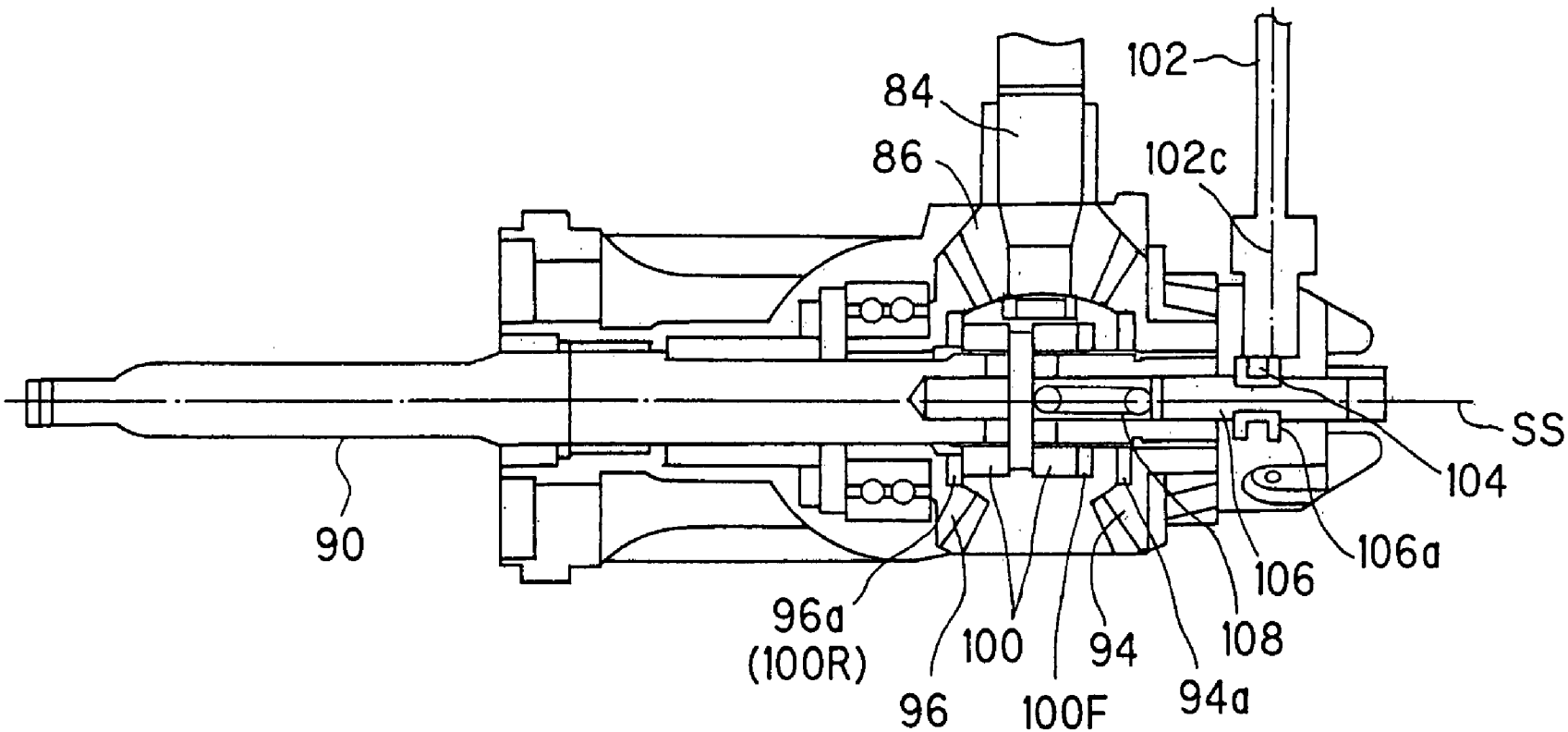
FIG. 6 is an enlarged sectional view of a vicinity of the propeller shaft shown in FIG. 3.

On the other hand, as shown in FIG. 6, when the shift rod 102 is rotated counterclockwise (viewed from the top) by 45 degrees from the neutral position, the shift slider 106 and shifter clutch 100 slide toward the reverse bevel gear 96, and the claws 100R formed on the shifter clutch 100 are meshed with the claws 96*a* formed on the reverse bevel gear 96. With this, the reverse position is established and the rotation of the drive shaft 84 is transmitted through the pinion gear 86 and reverse bevel gear 96 to the propeller shaft 90 such that the propeller 32 rotates in the direction opposite from that during forward travel of the boat 12.

The explanation of FIG. 3 will be resumed.

The shift rod 102 extends and penetrates the gear case 82 and swivel case 54 (more precisely, the interior space of the swivel shaft 56 housed therein), and finally reaches at a location in the vicinity of the engine cover 30 at its top end. The top end of the shift rod 102 is connected with the electric shift motor 38 via a speed reduction gear mechanism 110.

Figure 7:
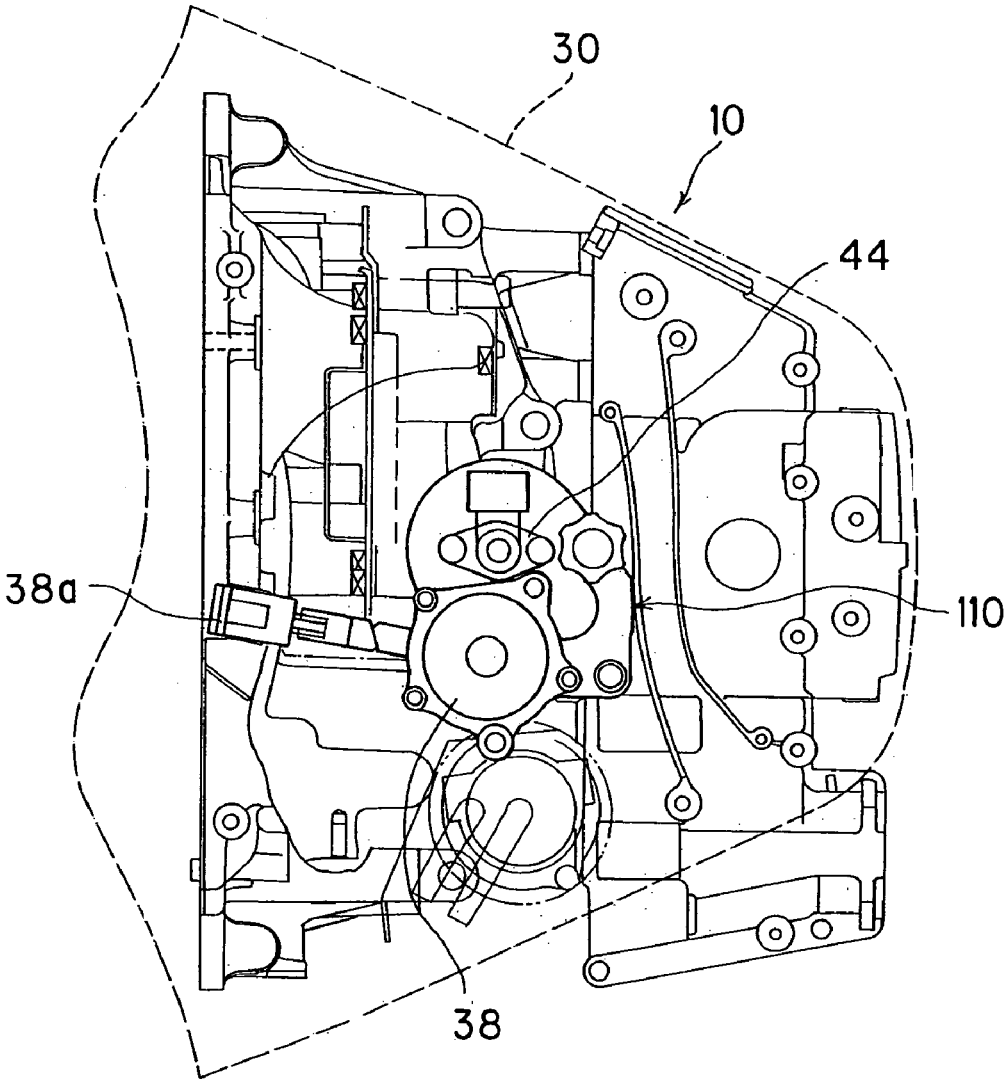
FIG. 7 is a partial sectional view taken along line VII—VII in FIG. 3.

FIG. 7 is a partial sectional view taken along line VII—VII in FIG. 3.

As shown, the speed reduction gear mechanism 110 and the shift position sensor 44 are integrally attached to the electric shift motor 38. The symbol 38*a* in the drawing designates a harness interconnecting the electric shift motor 38 and the ECU 26.

Figure 8:
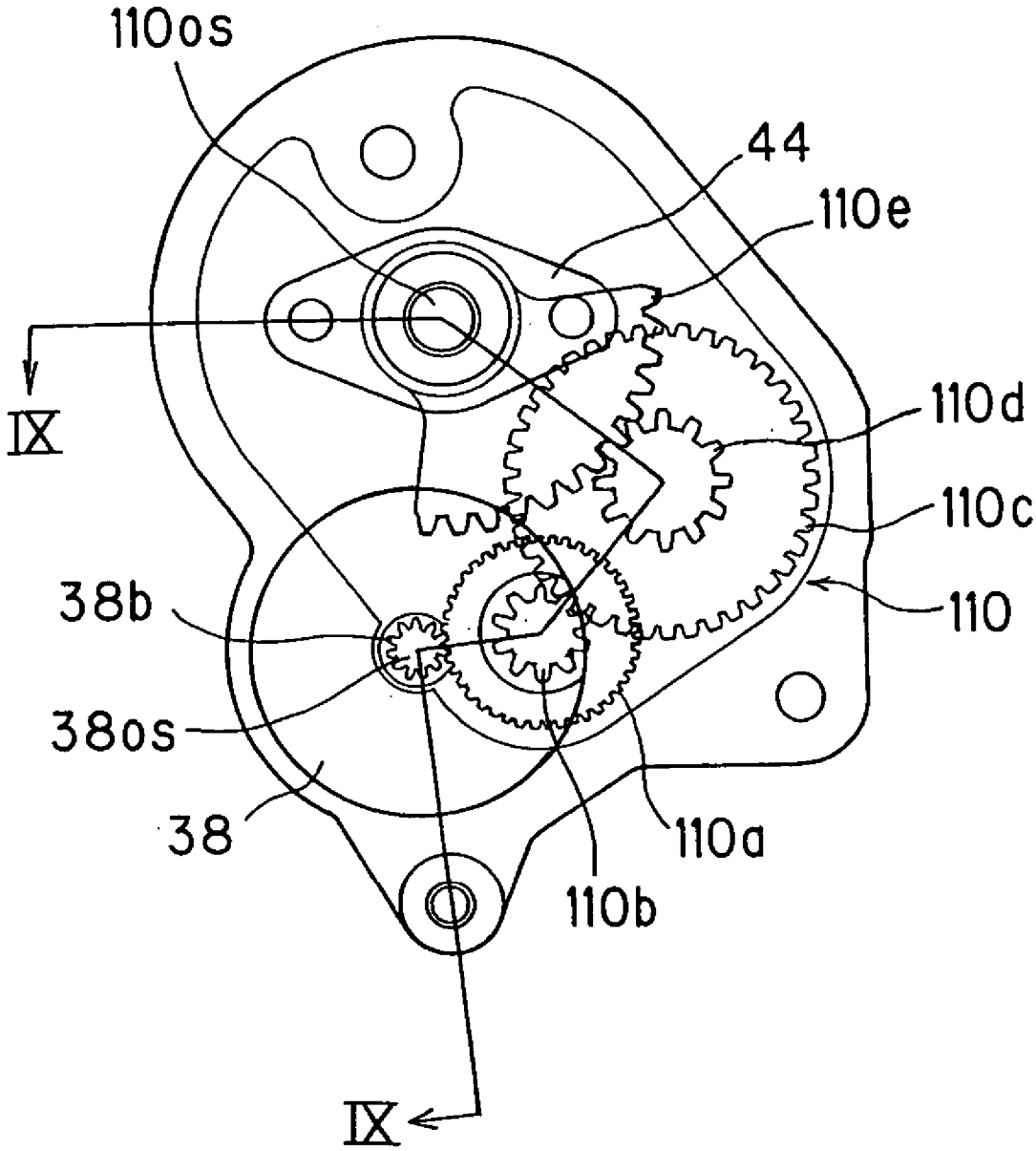
FIG. 8 is a partial perspective view showing an enlarged view of a part of FIG. 7.
Figure 9:
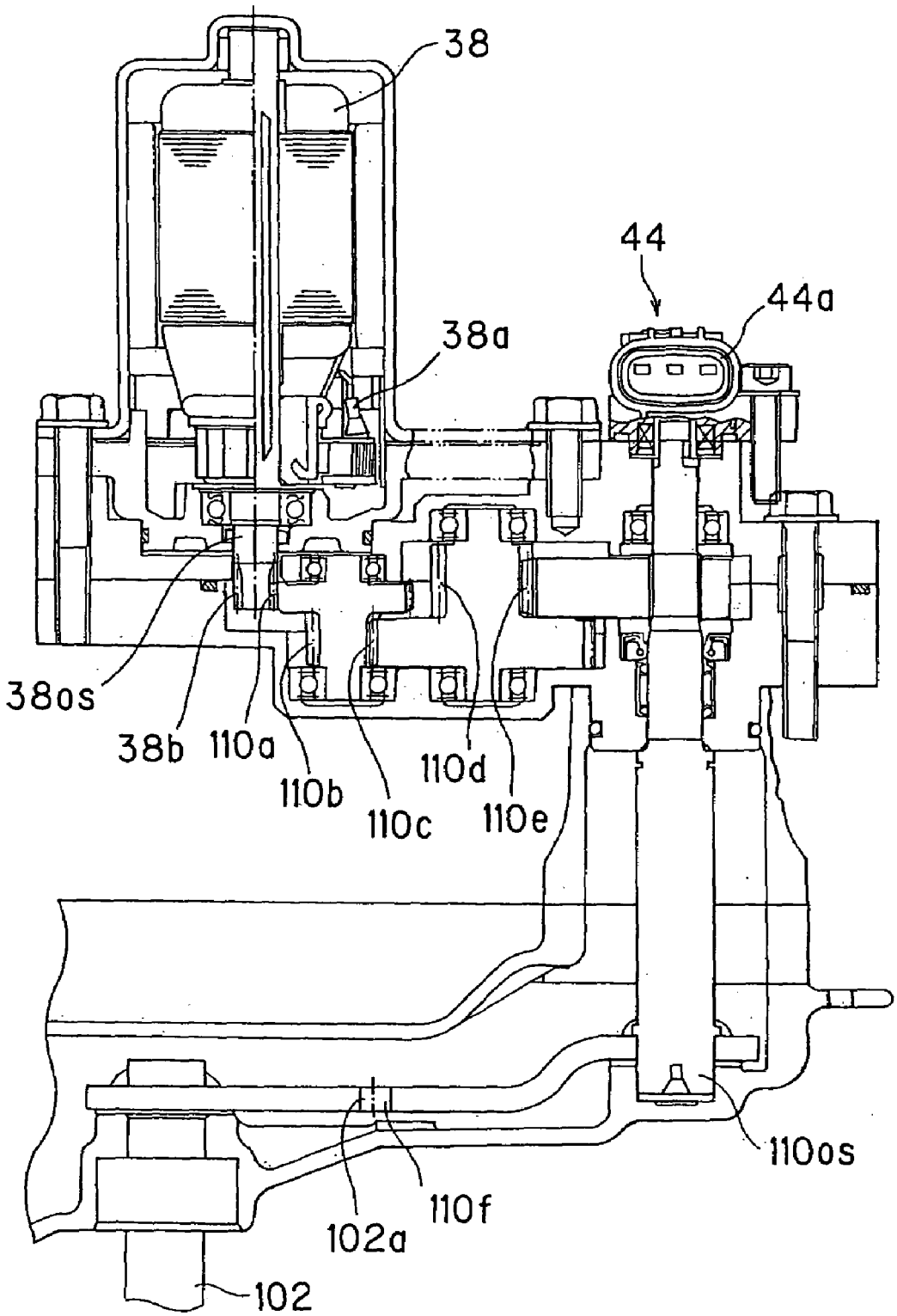
FIG. 9 is a sectional view taken along line IX—IX in FIG. 8.

FIG. 8 is a partial perspective view showing an enlarged view of a part of FIG. 7. FIG. 9 is a sectional view taken along line IX—IX in FIG. 8.

As shown best in FIGS. 8 and 9, a gear 38*b* is fitted on the output shaft 38*os* of the electric shift motor 38, and the gear 38*b* is meshed with a gear 110*a* of the speed reduction gear mechanism 110 that has a larger diameter than the gear 38*b*. A gear 110*b* of smaller diameter than the gear 110*a* is attached coaxially therewith, and the gear 110*b* is meshed with a gear 110*c* that has a larger diameter than the gear 110*b*. A gear 110*d* of smaller diameter than the gear 110*c* is attached coaxially therewith.

A gear 110*e* of larger diameter than the gear 110*d* is fitted on an output shaft 110*os* of the speed reduction gear mechanism 110, and the gear 110*e* is meshed with the gear 110*d*. Further, as shown in FIG. 9, a gear 110*f* is fitted on the output shaft 110*os* at a location near the lower end thereof. The gear 110*f* is meshed with a gear 102*a* attached at a location near the upper end of the shift rod 102. Therefore, when the electric shift motor 38 is operated, its output is reduced in speed by the speed reduction gear mechanism 110 and transmitted to the shift rod 102, thereby operating the shift mechanism to establish one from among the shift positions including the forward position, the reverse position and the neutral position.

In addition, the shift position sensor 44 is installed immediately above the output shaft 110*os* of the speed reduction gear mechanism 110. The shift position sensor 44 is connected to the ECU 26 through a connector 44*a* and harness (not shown) and sends the ECU 26 a signal indicative of the angle of rotation of the output shaft 110*os*, and thus indicative of the angle of rotation of the shift rod 102 (in other words, one of the shift positions now being established by the shift mechanism).

The flow of the exhaust gas emitted from the engine 28 will now be explained with reference to FIG. 3.

As indicated by the arrows in FIG. 3, the exhaust gas emitted by the engine 28 is discharged into the extension case 80 from the exhaust pipe 114. When the shift position is neutral or forward, the exhaust gas discharged into the extension case 80 further passes through the interior of the extension case 80 and the interior of the propeller boss portion 92 to be discharged into the water to the rear of the propeller 32. When the water pressure (backpressure acting on the propeller boss portion 92) is greater than the exhaust pressure owing to low engine speed NE, the engine exhaust gas is discharged into the air through an idle port (not shown). This exhaust gas passage from the extension case 80 to the propeller boss portion 92 is a first exhaust gas passage.

In addition to the first exhaust gas passage, the extension case 80 of the outboard motor 10 is formed with a second exhaust gas passage 80*a* for the exhaust gas generated by the engine 28. As illustrated, the second exhaust gas passage 80*a* is formed vertically above the water surface (designated by the symbol SW) to pass from the interior of the outboard motor 10 (more exactly, the interior of the extension case 80) to the exterior (into the outside air; more exactly, into the air to the rear of the outboard motor 10 (rear relative to the direction of forward travel)). In other words, the second exhaust gas passage 80*a* is branched from the first exhaust gas passage at a location above the water (water surface). An exhaust valve 112 is provided in the exhaust gas passage 80*a*.

Figure 10:
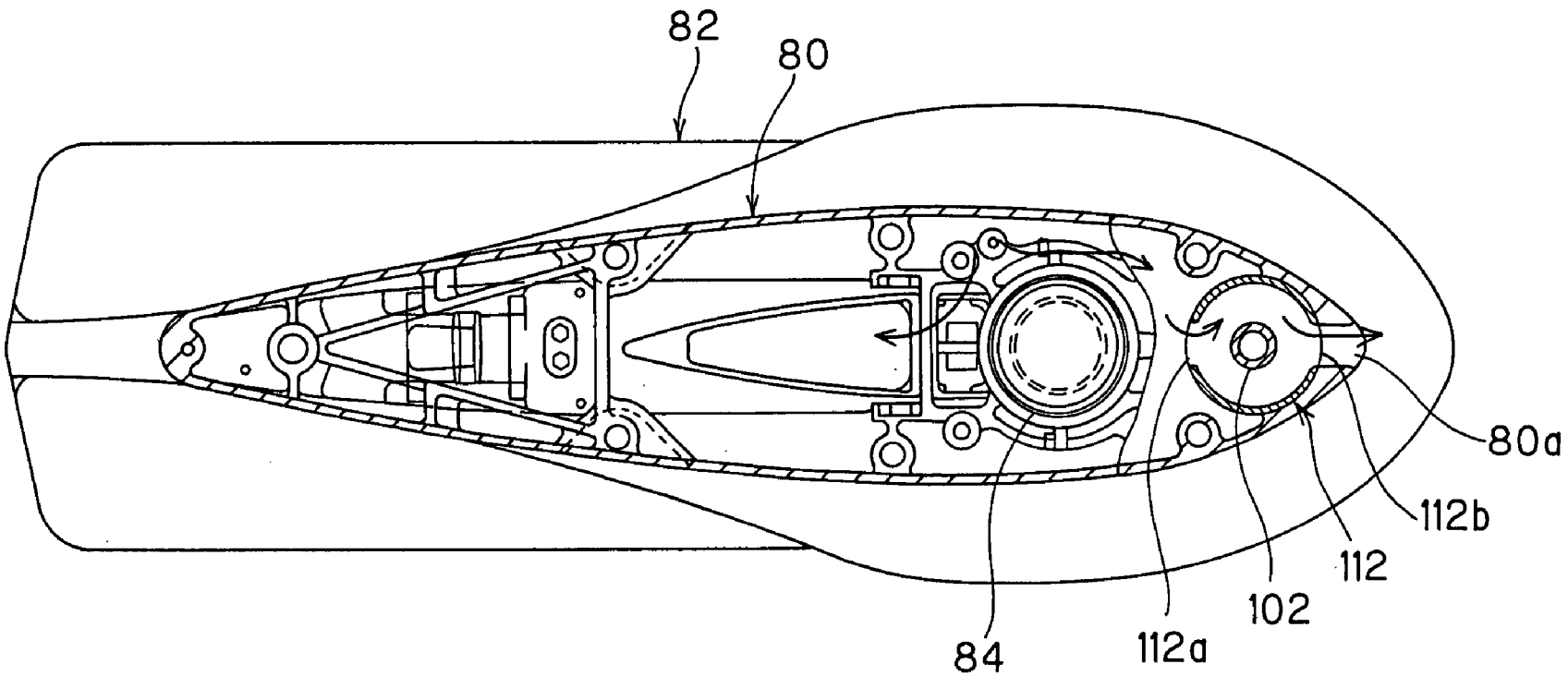
FIG. 10 is an enlarged sectional view taken along line X—X in FIG. 3.

FIG. 10 is an enlarged sectional view taken along line X—X in FIG. 3. The drawing shows the outboard motor 10 with the shift position reverse.

As shown in FIG. 10, the exhaust valve 112 is cylindrical and has two openings 112*a* and 112*b* formed at diametrically opposite locations thereof. The shift rod 102 is fastened to the middle of exhaust valve 112 to be centered on its axis of rotation. Therefore, when the electric shift motor 38 is operated to rotate the shift rod 102, the positions of the openings 112*a* and 112*b* are changed.

When the shift position is reverse as illustrated (i.e., the reverse position is established), the exhaust valve 112 is opened. Specifically, the opening 112*a* on one side of the exhaust valve 112 communicates with the interior of the extension case 80 and the opening 112*b* on the other side communicates with the exhaust gas passage 80*a*. The interior of the extension case 80 is therefore communicated with the outside air.

Figure 11:
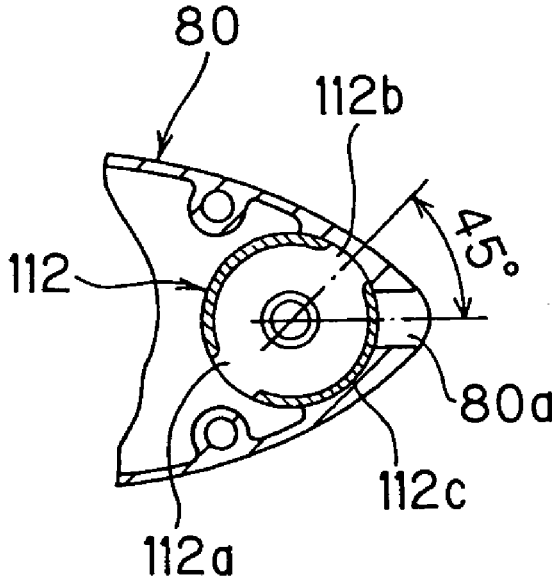
FIG. 11 is a partial sectional view showing an exhaust valve shown in FIG. 10.
Figure 12:
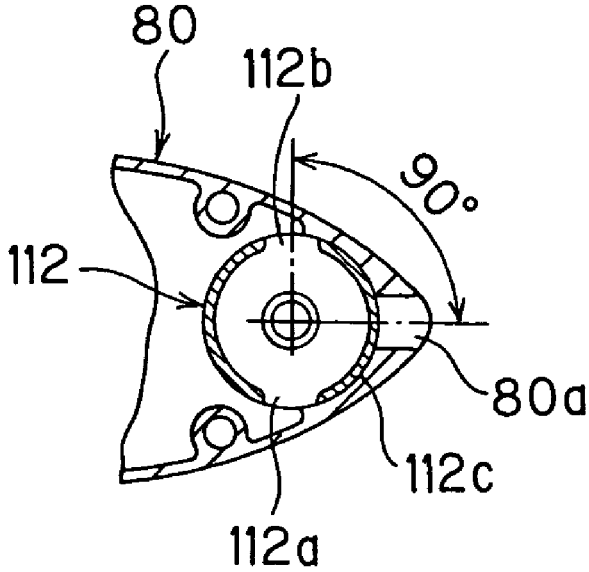
FIG. 12 is a partial sectional view similarly showing the exhaust valve shown in FIG. 10.

FIG. 11 is a partial sectional view showing the exhaust valve 112 when the shift position is neutral, and FIG. 12 is a partial sectional view showing the exhaust valve 112 when the shift position is forward.

As shown in FIGS. 11 and 12, when the shift position is neutral or forward, the exhaust valve 112 is closed. Specifically, the cylindrical side wall 112*c* of the exhaust valve 112 shuts the exhaust gas passage 80*a*. Thus, the exhaust gas is discharged into the extension case 80 from the exhaust pipe 114 and further passes through the interior of the extension case 80 and the interior of the propeller boss portion 92 to be discharged into the water to the rear of the propeller 32, when the shift position is neutral or forward (when the exhaust valve 112 is closed).

On the other hand, as indicated by the arrows in FIGS. 3 and 10, when the shift position is reverse (when the reverse position is established and the exhaust valve 112 is opened), the exhaust gas in the extension case 80 is discharged into the outside air through the exhaust valve 112 along the second exhaust gas passage 80*a*. During reverse boat travel, since cruising in the low-speed region is predominant, the exhaust pressure seldom exceeds the backpressure and most of the exhaust gas is therefore discharged into the air through the exhaust valve 112 and the aforesaid idle port.

The operation of the outboard motor exhaust system according to this embodiment will now be explained.

Figure 13:
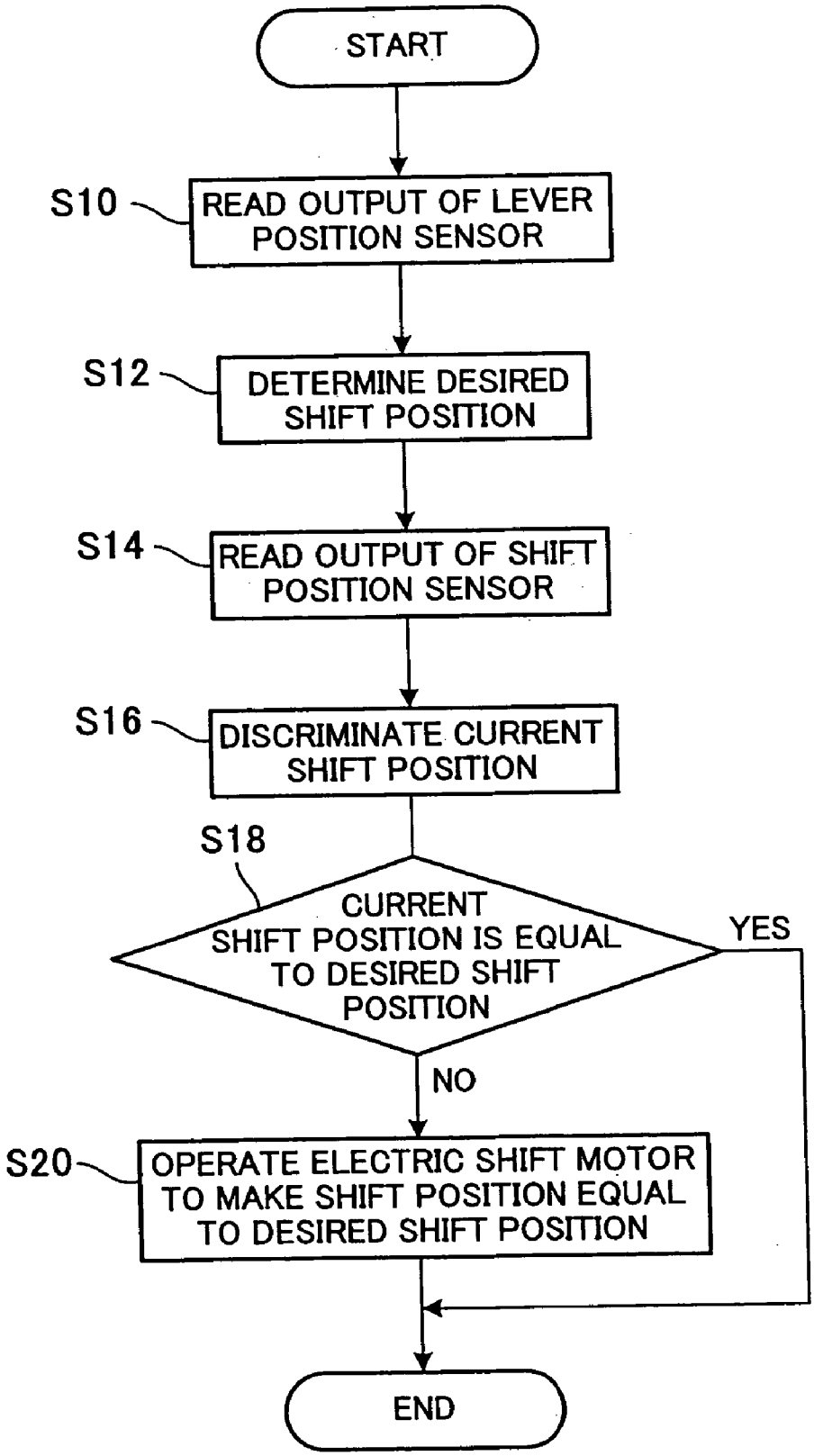
FIG. 13 is a flowchart showing the flow of the operation of the outboard motor exhaust system according to the first embodiment of this invention.

FIG. 13 is a flowchart showing the flow of the operation. The routine shown in the drawing is executed in the ECU 26 at prescribed time intervals.

First, in S10, the output value of the lever position sensor 24 (i.e., the position of the operation lever 22) is read, whereafter, in S12, a desired shift position is determined based on the read output value of the lever position sensor 24. Specifically, the manipulation direction of the operation lever 22 is discriminated from the output of the lever position sensor 24 and a desired shift position is determined as one among forward, neutral and reverse in response to the discriminated manipulation direction.

The ECU 26 also executes another routine by which a desired throttle opening is determined based on the magnitude of the output value of the lever position sensor 24 (i.e., the amount of manipulation of the operation lever 22) and the operation of the electric throttle motor 36 is controlled to make the current throttle opening θTH detected by the throttle opening sensor 42 equal to the desired throttle opening. Thus, the operation lever 22 functions as a device for allowing the operator to input an instruction to change shift position and also functions as a device for allowing the operator to input a required throttle opening (required by the operator).

The explanation with reference to the flowchart of FIG. 13 will be continued. Next, in S14, the output value of the shift position sensor 44 is read, whereafter, in S16, the current shift position is discriminated from the output value of the shift position sensor 44. Then, in S18, it is checked whether the current shift position is equal to the desired shift position.

When the result in S18 is NO, the program proceeds to S20, in which the operation of the electric shift motor 38 is controlled to make the shift position equal to the desired shift position. At this time, if the desired shift position is reverse, i.e., if the shift mechanism is to be operated to establish the reverse position, the exhaust valve 112 is opened in response to or synchronously with the shift mechanism operation to discharge the exhaust gas emitted by the engine 28 through the exhaust valve 112 into the outside air. When the result in S18 is YES, S20 is skipped.

Thus the outboard motor exhaust system according to the first embodiment of the invention is equipped with the electric shift motor 38 for operating the shift mechanism to establish one from among the forward position, reverse position and neutral position, the second exhaust gas passage 80*a* branching from the first exhaust gas passage at a location above the water level SW, and the exhaust valve 112 installed in the second exhaust gas passage 80*a* and linked with the shift mechanism (specifically the shift rod 102 thereof) so as to be opened in response to or synchronously with the operation of the shift mechanism when the shift mechanism is operated to establish the reverse position.

In other words, a configuration is adopted wherein the exhaust valve 112 for discharging the exhaust gas of the engine 28 into the air and the shift mechanism for establishing one from among the three shift positions are both operated by an actuator (the electric shift motor 38). As a result, it is possible to prevent the decrease in thrust produced during reverse boat travel by exhaust gas from the engine 28 being sucked in by the propeller 32, without degrading the shift feel. Moreover, this effect is achieved with a simple structure in which the exhaust valve 112 and the shift mechanism are operated by a single actuator.

Figure 14:
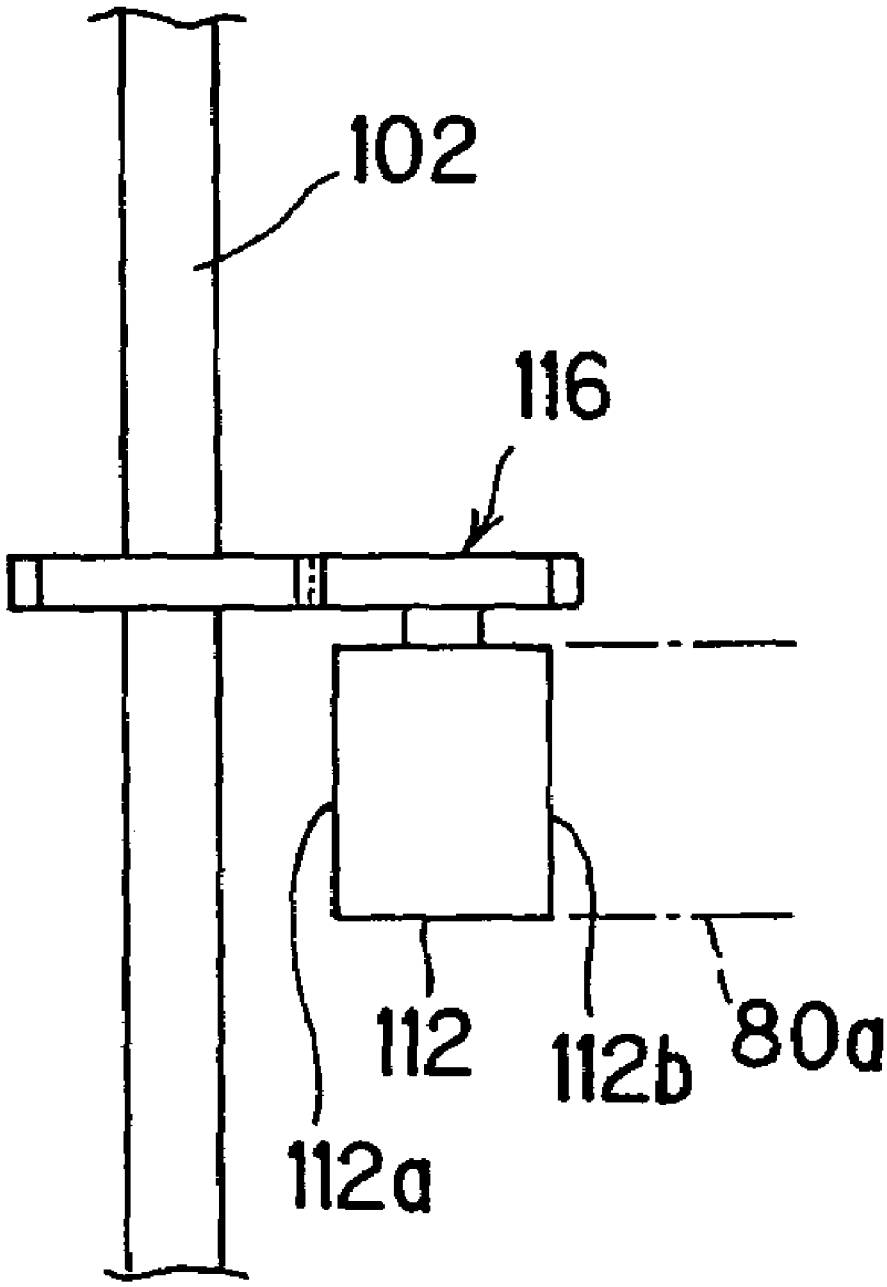
FIG. 14 is a schematic view showing an alternative example of the outboard motor exhaust system according to the first embodiment of this invention.

Although in the configuration explained in the foregoing the shift rod 102 is directly attached to the center region of the exhaust valve 112, it is possible instead, as shown in FIG. 14, to interconnect the shift rod 102 and exhaust valve 112 through an intervening gear mechanism 116. This arrangement enables the amount of opening of the exhaust valve 112 per unit rotation angle of the shift rod 102 to be defined as desired.

An outboard motor exhaust system according to a second embodiment of the invention will now be explained.

Figure 15:
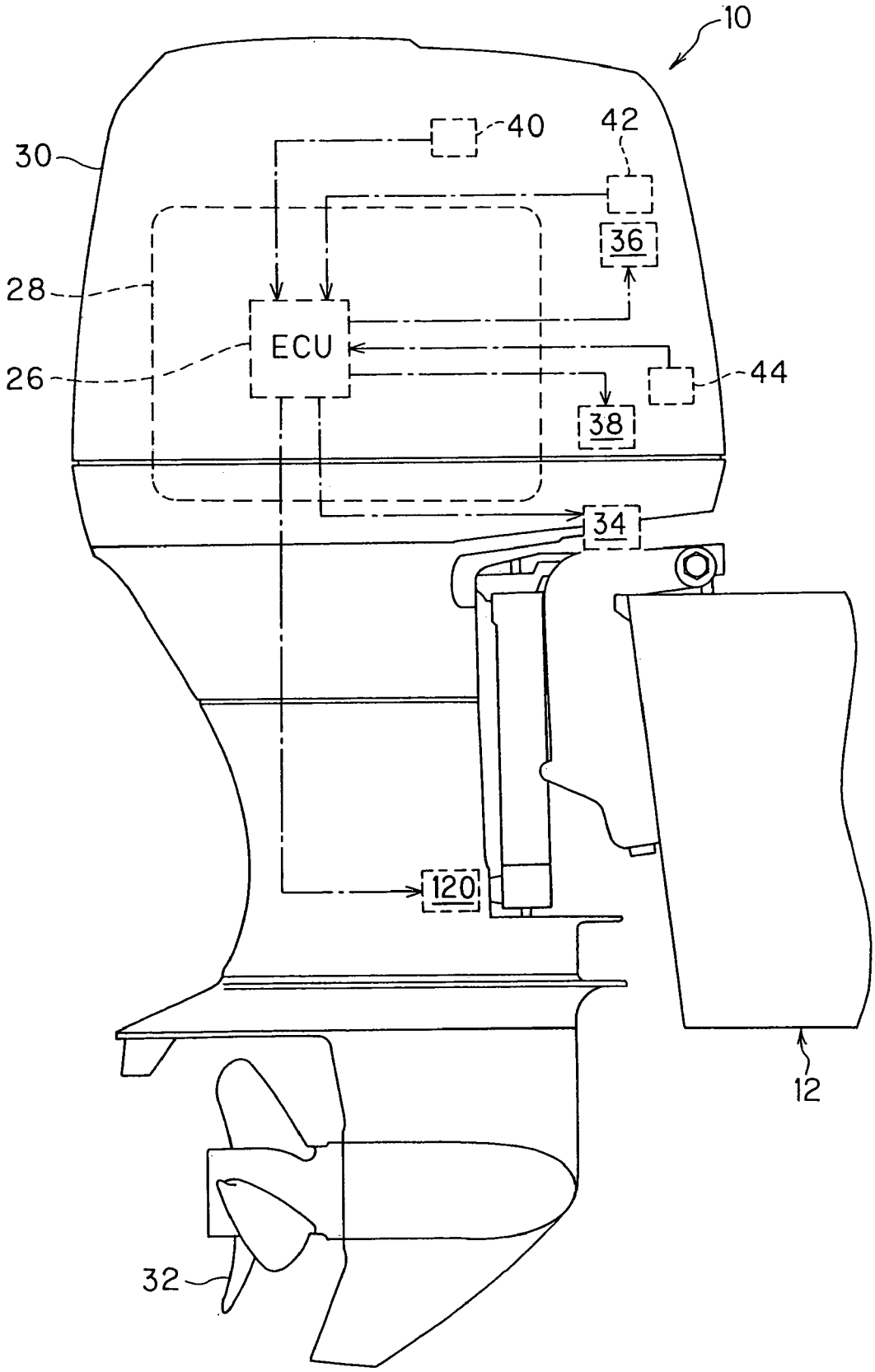
FIG. 15 is a side view, similar to FIG. 2, schematically illustrating an outboard motor exhaust system according to a second embodiment of this invention.

FIG. 15 is a side view, similar to FIG. 2, schematically illustrating an outboard motor exhaust system according to the second embodiment.

The explanation will focus on points of difference from the first embodiment. As shown in FIG. 15, in the second embodiment an electric exhaust valve motor (exhaust valve actuator) 120 is provided for opening and closing the exhaust valve 112.

Figure 16:
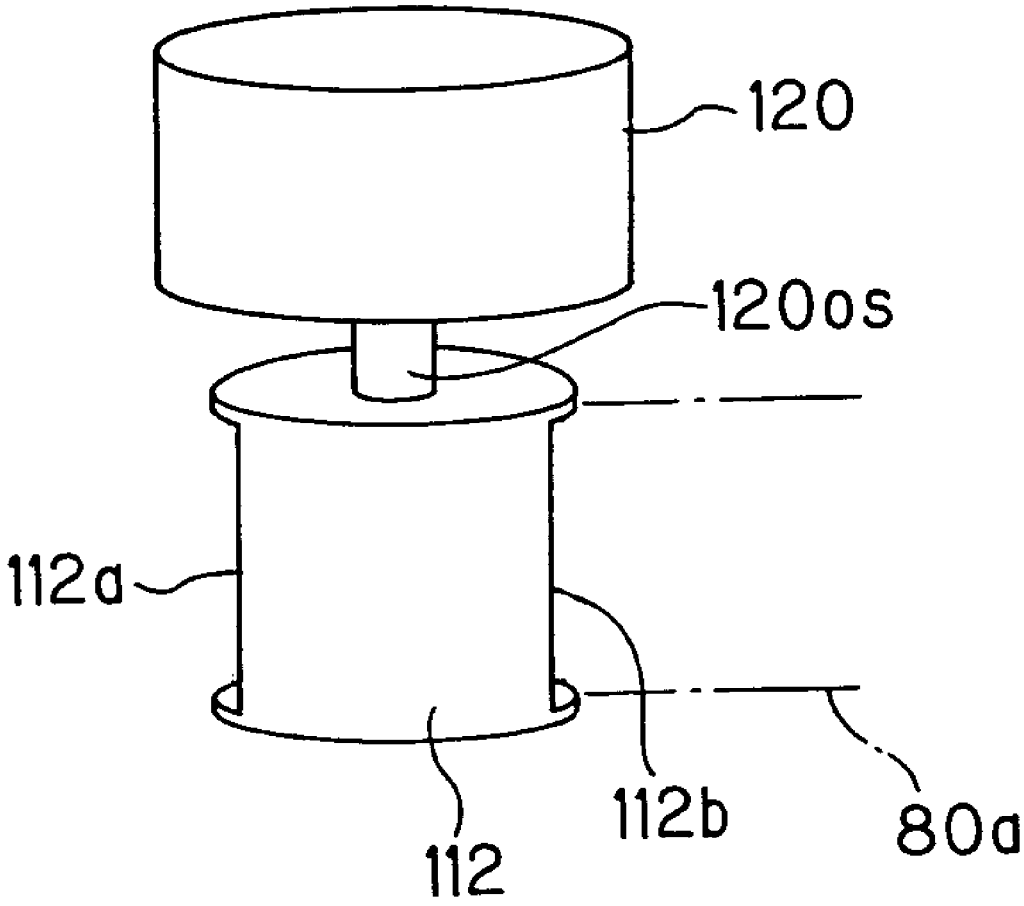
FIG. 16 is a view showing an electric exhaust valve motor and an exhaust valve shown in FIG. 15.

FIG. 16 is a view showing the electric exhaust valve motor 120 and exhaust valve 112.

As illustrated in the figure, instead of the shift rod 102, an output shaft 120*os* of the electric exhaust valve motor 120 is connected to the middle of the exhaust valve 112 (to be centered on its axis of rotation). Although omitted in the drawing, a gear mechanism can be interposed between the exhaust valve 112 and output shaft 120*os*.

The electric exhaust valve motor 120 is connected to the ECU 26 through a harness not shown in the drawing. The ECU 26 controls the operation of the electric shift motor 38 and electric exhaust valve motor 120 based on the output value of the shift position sensor 44 and the output value (indicative of the engine speed NE) of the crank angle sensor 40.

Figure 17:
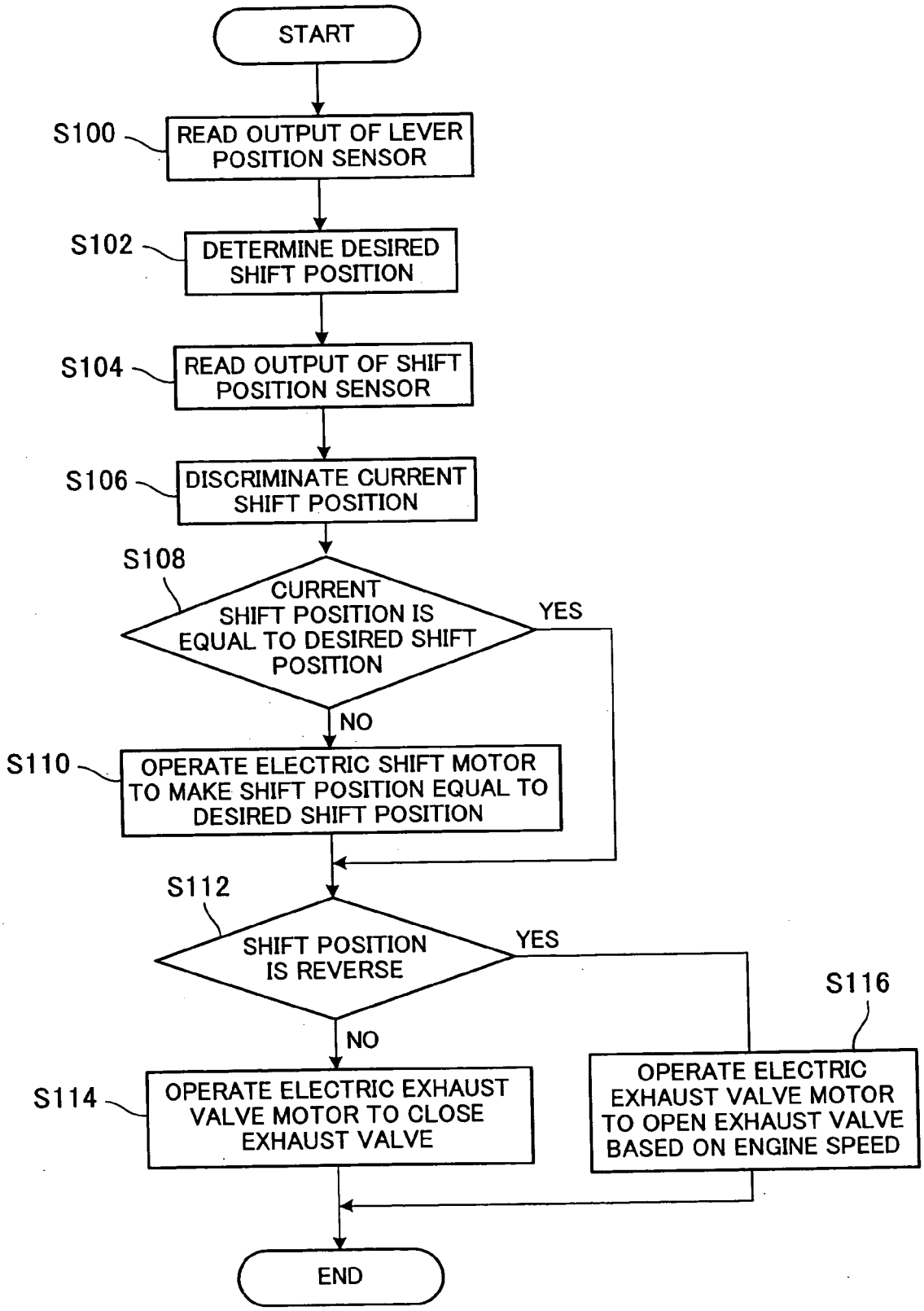
FIG. 17 is a flowchart showing the flow of the operation of the outboard motor exhaust system according to the second embodiment.

FIG. 17 is a flowchart showing the flow of the operation of the outboard motor exhaust system according to the second embodiment. The routine shown in the drawing is executed in the ECU 26 at prescribed time intervals.

First, in S100, the output value of the lever position sensor 24 is read, whereafter, in S102, the desired shift position is determined based on the output value of the lever position sensor 24. Then, in S104, the output value of the shift position sensor 44 is read. Next, in S106, the current shift position is discriminated from the output value of the shift position sensor 44. Then, in S108, it is checked whether the current shift position is equal to the desired shift position.

When the result in S108 is NO, the program proceeds to S110, in which the electric shift motor 38 is operated to operate the shift mechanism so as to make the shift position equal to the desired shift position. When the result in S108 is YES, S110 is skipped.

Next, in S112, it is checked whether the current shift position is reverse (i.e., the reverse position is established). When the result in S112 is NO, the program proceeds to S114, in which the operation of the electric exhaust valve motor 120 is controlled to close the exhaust valve 112. When the result in S112 is YES, the program proceeds to S116, in which the operation of the electric exhaust valve motor 120 is controlled based on the detected engine speed NE. In other words, the opening of the exhaust valve 112 is regulated based on the engine speed NE.

Figure 18:
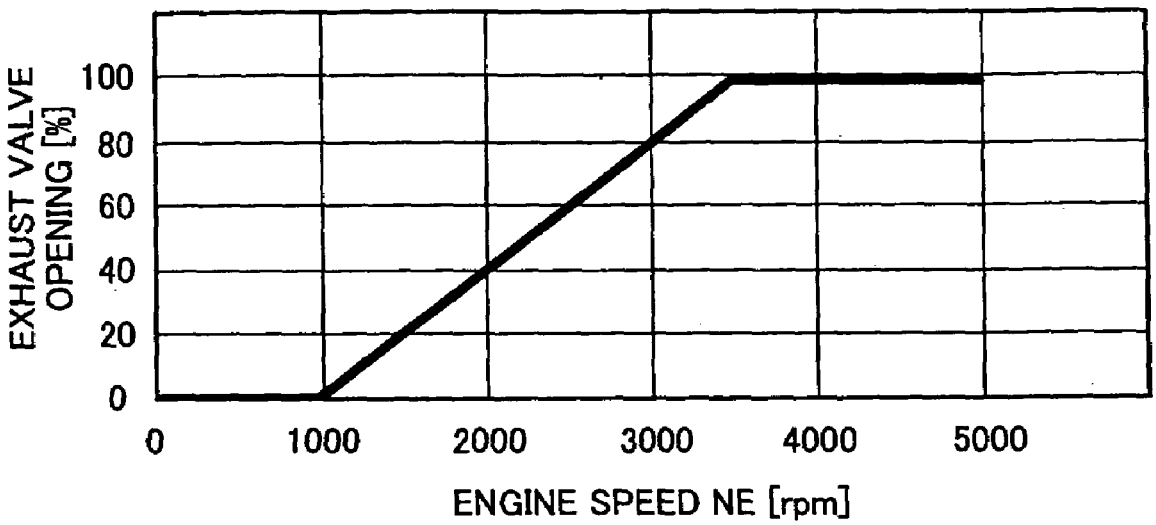
FIG. 18 is a graph showing a curve representing the opening characteristic of an exhaust valve relative to an engine speed, to be used in a processing of the operation of the electric exhaust valve motor shown in FIG. 17.

FIG. 18 is a graph showing a curve representing the opening characteristic of the exhaust valve 112 relative to the engine speed NE.

As can be seen, the characteristic curve is defined such that the opening of the exhaust valve 112 increases with increasing engine speed NE. This is because the flow rate of the exhaust gas to be discharged from the exhaust valve 112 increases in proportion as the engine speed NE increases. In S116 of the flowchart of FIG. 17, the opening of the exhaust valve 112 corresponding to the current engine speed NE is determined by referring to the characteristic curve of FIG. 18 and the operation of the electric exhaust valve motor 120 is controlled to establish the so-determined valve opening. In FIG. 18 and on, the opening of the exhaust valve 112 is defined by %, wherein 100% indicates the exhaust valve 112 is fully opened and 0% indicates the exhaust valve 112 is fully closed.

Thus the outboard motor exhaust system according to the second embodiment of the invention is equipped with the electric exhaust valve motor 120 for opening and closing the exhaust valve 112 and when the shift position of the outboard motor 10 is reverse (the reverse position is established), the operation of the electric exhaust valve motor 120 is controlled to open the exhaust valve 112. In other words, the exhaust valve 112 for discharging the exhaust gas of the engine 28 into the air through the second exhaust gas passage 80*a* is opened and closed by an actuator installed independent of the shift mechanism. As a result, it is possible to prevent the decrease in thrust produced during reverse boat travel by exhaust gas from the engine 28 being sucked in by the propeller 32, without degrading the shift feel.

Further, the opening of the exhaust valve 112 is regulated as a function of the engine speed NE. In other words, the opening of the exhaust valve 112 is regulated as a function of the exhaust gas flow rate. Since this makes it possible to set the opening of the exhaust valve 112 so as to be neither too large nor too small relative to the exhaust gas flow rate, exhaust noise can be reduced.

Other aspects of the second embodiment are the same as those of the first embodiment and will not be explained again here.

An outboard motor exhaust system according to a third embodiment of the invention will now be explained.

The foregoing second embodiment is configured so that when the shift position is reverse, the operation of the electric exhaust valve motor 120 is controlled based on the detected engine speed NE. In the third embodiment, the control is performed based on the detected throttle opening (the opening of the throttle valve 74) θTH instead of the engine speed NE.

Figure 19:
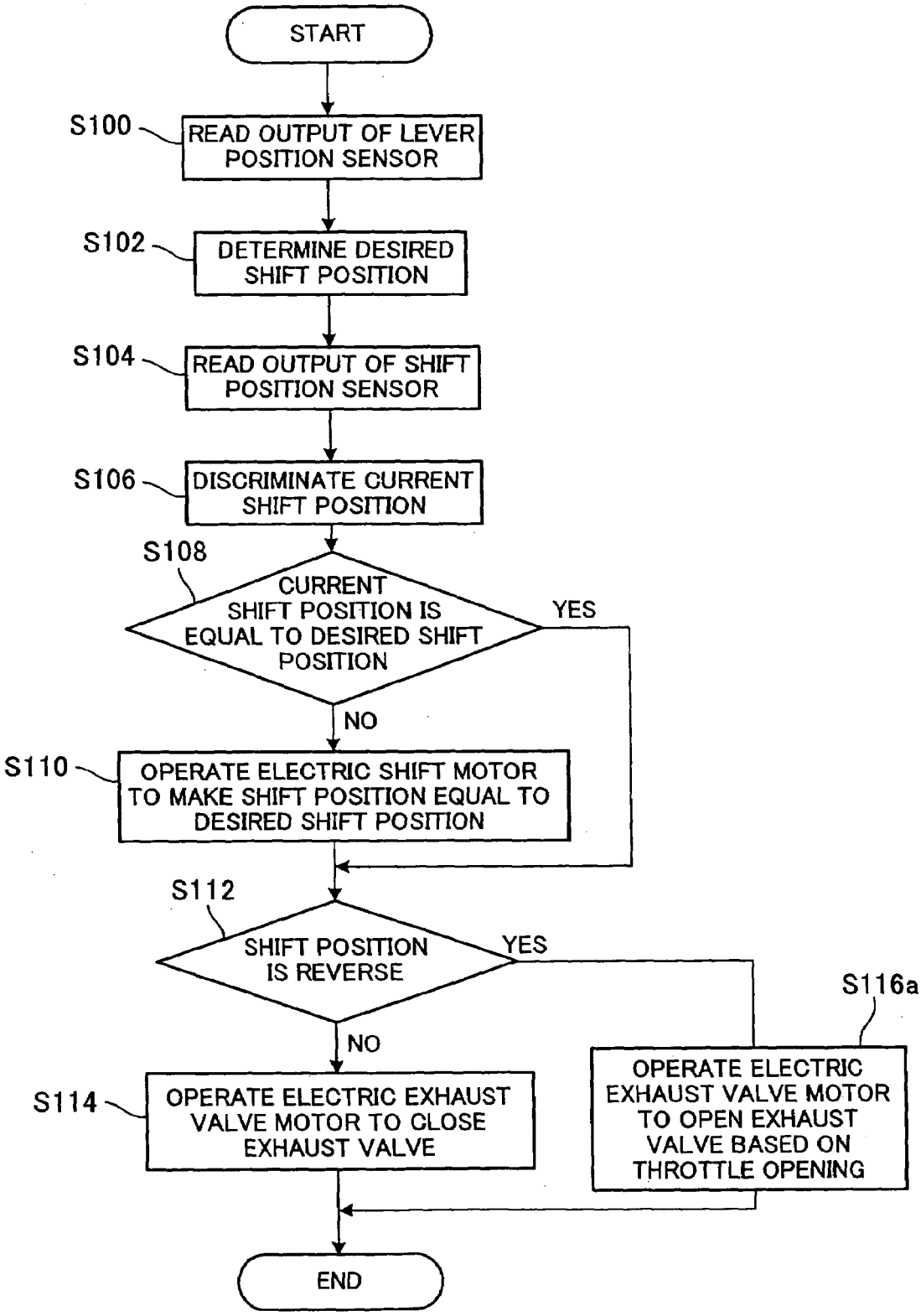
FIG. 19 is a flowchart showing the flow of the operation of an outboard motor exhaust system according to a third embodiment of this invention.

FIG. 19 is a flowchart showing the flow of the operation of the outboard motor exhaust system according to the third embodiment. The routine shown in the drawing is executed in the ECU 26 at prescribed time intervals.

The explanation of this flowchart will be made with focus on the points of difference from the flowchart of the second embodiment shown in FIG. 17. In the third embodiment, when the result in S112 is YES, i.e., when it is found that the shift position is reverse (the reverse position is established), the program proceeds to S116*a*, in which the operation of the electric exhaust valve motor 120 is controlled based on the throttle opening θTH detected by the throttle position sensor 42. In other words, the opening of the exhaust valve 112 is regulated based on the detected throttle opening θTH.

Figure 20:
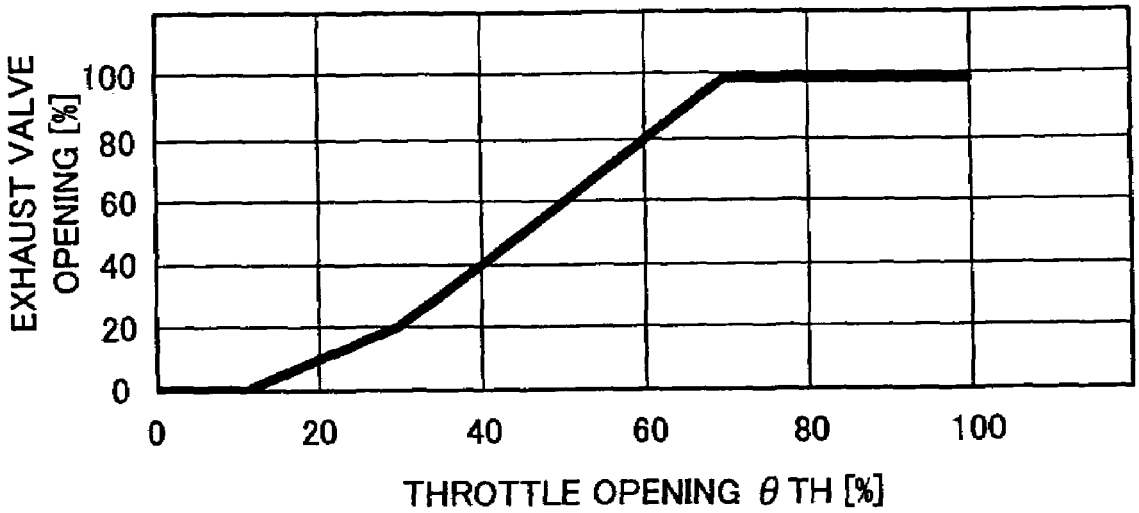
FIG. 20 is a graph showing a curve representing the opening characteristic of an exhaust valve relative to a throttle opening, to be used in a processing of the operation of an electric exhaust valve motor shown in FIG. 19.

FIG. 20 is a graph showing a curve representing the opening characteristic of the exhaust valve 112 relative to the throttle opening θTH.

As can be seen, the characteristic curve is defined such that the opening of the exhaust valve 112 increases with increasing throttle opening θTH. This is because the flow rate of the exhaust gas to be discharged from the exhaust valve 112 through the second exhaust gas passage 80*a* can be assumed to increase in proportion as the throttle opening θTH increases. In S116*a* of the flowchart of FIG. 19, the opening of the exhaust valve 112 corresponding to the current throttle opening θTH is determined by referring to the characteristic curve of FIG. 20 and the operation of the electric exhaust valve motor 120 is controlled to establish the so-determined valve opening. In FIG. 20 and on, the throttle opening θTH is defined by %, wherein 100% indicates the throttle valve 74 is fully opened and 0% indicates the throttle valve 74 is fully closed.

Thus in the outboard motor exhaust system according to the third embodiment of the invention, the opening of the exhaust valve 112 is regulated based on the detected throttle opening θTH. In other words, the opening of the exhaust valve 112 is regulated in proportion to the flow rate of the exhaust gas. Since this makes it possible to set the opening of the exhaust valve 112 so as to be neither too large nor too small relative to the exhaust gas flow rate, exhaust noise can be reduced.

Other aspects of the third embodiment are the same as those of the second embodiment and will not be explained again here.

An outboard motor exhaust system according to a fourth embodiment of the invention will now be explained.

In the fourth embodiment, the operation of the electric exhaust valve motor 120 is controlled based on the operator's required throttle opening (also the opening of the throttle valve 74), i.e., the amount of manipulation of the operation lever 22.

Figure 21:
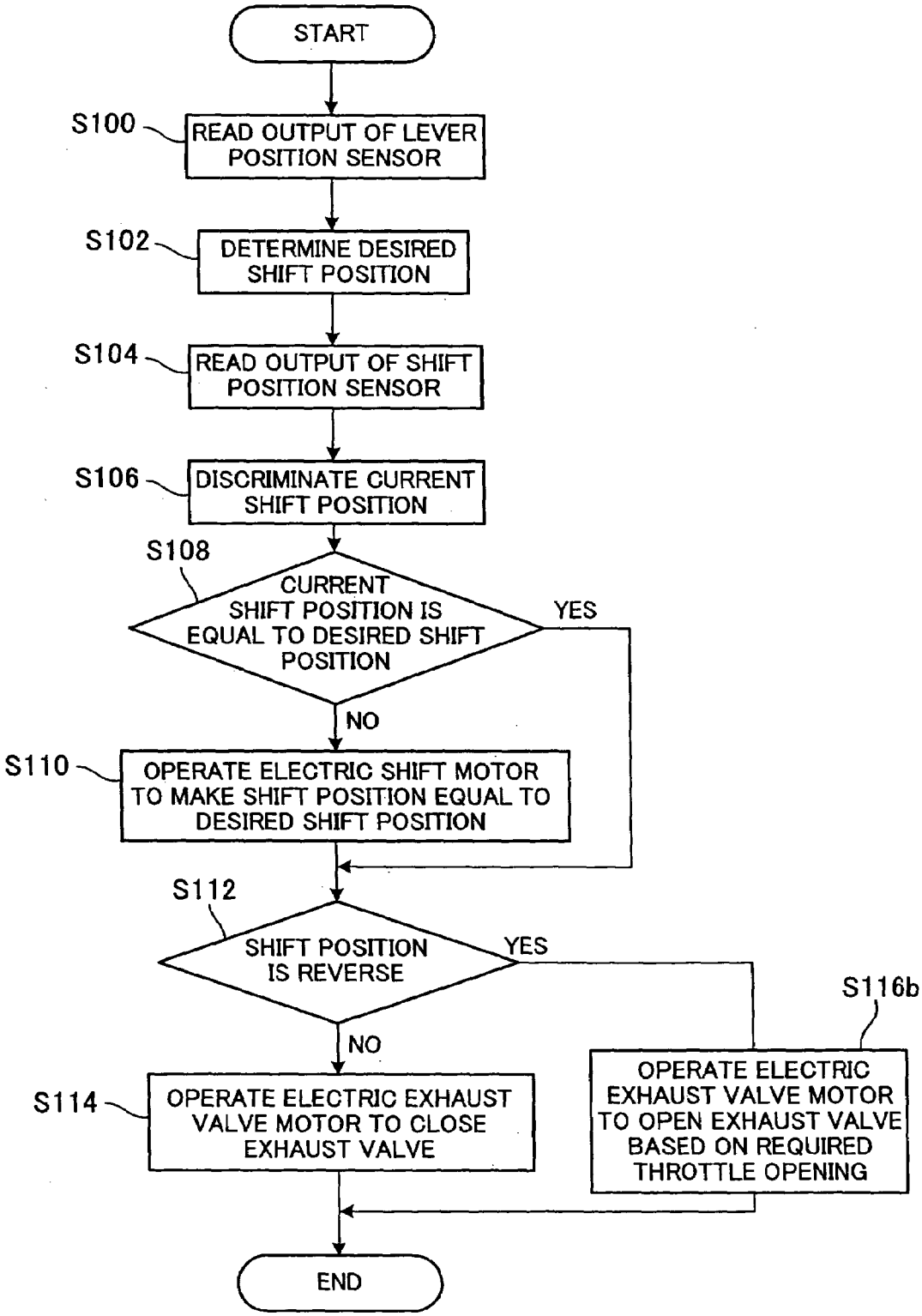
FIG. 21 is a flowchart showing the flow of the operation of an outboard motor exhaust system according to a fourth embodiment of this invention.

FIG. 21 is a flowchart showing the flow of the operation of the outboard motor exhaust system according to the fourth embodiment. The routine shown in the drawing is executed in the ECU 26 at prescribed time intervals.

The explanation of this flowchart will be made with focus on the points of difference from the flowchart of the second embodiment shown in FIG. 17. In the fourth embodiment, when the result in S112 is YES, i.e., when it is found that the shift position is reverse (the reverse position is established), the program proceeds to S116*b*, in which the operation of the electric exhaust valve motor 120 is controlled based on the output value of the lever position sensor 24, which is a parameter indicating the throttle opening required by the operator.

Figure 22:
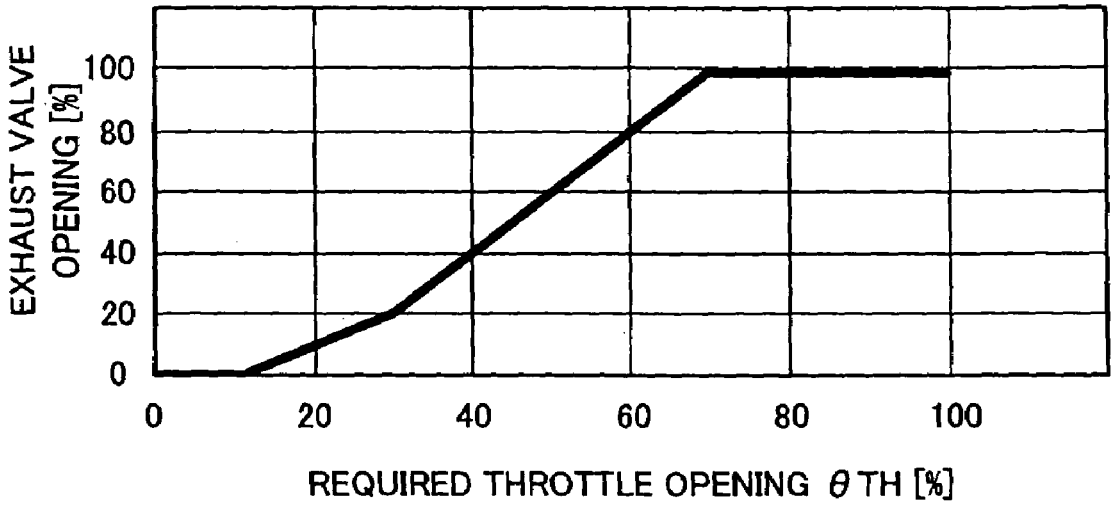
FIG. 22 is a graph showing a curve representing the opening characteristic of an exhaust valve relative to a throttle opening required by the operator, to be used in a processing of the operation of an electric exhaust valve motor shown in FIG. 21.

FIG. 22 is a graph showing a curve representing the opening characteristic of the exhaust valve 112 relative to the throttle opening required by the operator. As can be seen, the characteristic curve is defined such that the opening of the exhaust valve 112 increases with increasing required throttle opening. This is because the flow rate of the exhaust gas to be discharged from the exhaust valve 112 can be assumed to increase in proportion as the operator's required throttle opening increases. In S116*b* of the flowchart of FIG. 21, the opening of the exhaust valve 112 corresponding to the required throttle opening (i.e., corresponding to the output value of the lever position sensor 24) is determined by referring to the characteristic curve of FIG. 22 and the operation of the electric exhaust valve motor 120 is controlled to establish the so-determined valve opening.

Thus in the outboard motor exhaust system according to the fourth embodiment of the invention, the opening of the exhaust valve 112 is regulated based on the operator's required throttle opening. In other words, the opening of the exhaust valve 112 is regulated in proportion to the flow rate of the exhaust gas. Since this makes it possible to set the opening of the exhaust valve 112 so as to be neither too large nor too small relative to the exhaust gas flow rate, exhaust noise can be reduced.

Other aspects of the fourth embodiment are the same as those of the second embodiment and will not be explained again here.

Thus, the first embodiment is configured to have an exhaust system of an outboard motor (10) mounted on a stern of a boat (12) and having an internal combustion engine (28) to power a propeller (32) and a first exhaust gas passage discharging exhaust gas generated by the engine into water, comprising: a shift actuator (electric shift motor 38) operating a shift mechanism to establish one from among a forward position, a reverse position and a neutral position; a second exhaust gas passage (80*a*) branched from the first exhaust gas passage at a location above the water; and an exhaust valve (112) installed in the second exhaust gas passage and connected to the shift mechanism to be opened when the reverse position is established.

In the exhaust system, the first exhaust gas passage is opened at a portion (boss portion 92) rearward of the propeller 32.

The second to fourth embodiments are configured to have an exhaust system of an outboard motor (10) mounted on a stern of a boat (12) and having an internal combustion engine (28) to power a propeller (32) and a first exhaust gas passage discharging exhaust gas generated by the engine into water, comprising: a shift mechanism establishing one from among a forward position, a reverse position and a neutral position; a second exhaust gas passage (80*a*) branched from the first exhaust gas passage at a location above the water; an exhaust valve (112) installed in the second exhaust gas passage; an exhaust valve actuator (electric exhaust valve motor 120) connected to the exhaust valve; and a control unit (ECU 26) controlling operation of the exhaust valve actuator to open the exhaust valve when the reverse position is established.

The exhaust system further includes: a shift actuator (electric shift motor 38) operating the shift mechanism to establish one from among the forward position, the reverse position and the neutral position.

In the exhaust system, the first exhaust gas passage is opened at a portion (boss portion 92) rearward of the propeller 32.

The exhaust system further includes: an engine speed detector (crank angle sensor 40) detecting a speed of the engine (NE); and the control unit controls the operation of the exhaust valve actuator 120 to open the exhaust valve 112 based on the detected engine speed when the reverse position is established, more specifically, the control unit controls the exhaust valve actuator 120 to increase an opening of the exhaust valve 112 with increasing engine speed.

The exhaust system further includes: a throttle position sensor (42) detecting an opening of a throttle valve (74) installed at an air intake passage (70) of the engine; and the control unit controls the operation of the exhaust valve actuator 120 to open the exhaust valve 112 based on the detected throttle opening when the reverse position is established, more specifically, the control unit controls the exhaust valve actuator 120 to increase an opening of the exhaust valve 112 with increasing throttle opening.

The exhaust system further includes: a device (operation lever 22) for allowing an operator to input a required opening of a throttle valve (74) installed at an air intake passage (70) of the engine; and the control unit controls the operation of the exhaust valve actuator 120 to open the exhaust valve 112 based on the required throttle opening when the reverse position is established, more specifically, the control unit controls the exhaust valve actuator 120 to increase an opening of the exhaust valve 112 with increasing required throttle opening.

It should be noted in the above that, although the exhaust valve 112 is formed to be a cylindrical valve, it can instead be any of various other types of valves (such as a butterfly valve).

It should also be noted in the above that, although the actuators serving as the drive sources of the shift rod 102, exhaust valve 112 and so on are exemplified as electric motors, they can instead be any of various other types of actuators (such as hydraulic actuators or magnetic solenoids).

It should further be noted that, in the second to fourth embodiments, the actuator for driving the exhaust valve 112 is provided independently of the shift mechanism (is a dedicated actuator). It is therefore alternatively possible to adopt a configuration in which the shift position is changed manually (without use of an actuator).

Japanese Patent Application No. 2004-252574 filed on Aug. 31, 2004 is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An exhaust system of an outboard motor adapted to be mounted on a stem of a boat and having an internal combustion engine to power a propeller and a first exhaust gas passage discharging exhaust gas generated by the engine into water, comprising:

a shift actuator operating a shift rod of a shift mechanism to establish one from among a forward position, a reverse position and a neutral position;

a second exhaust gas passage branched from the first exhaust gas passage at a location above the water; and an exhaust valve installed in the second exhaust gas passage and fastened coaxially around the shift rod of the shift mechanism to be opened by a rotation of the shift rod when the reverse position is established.

2. The exhaust system according to claim 1, wherein the first exhaust gas passage is opened at a portion rearward of the propeller.

3. An exhaust system of an outboard motor mounted on a stem of a boat and having an internal combustion engine to power a propeller and a first exhaust gas passage discharging exhaust gas generated by the engine into water, comprising:

a shift mechanism establishing one from among a forward position, a reverse position and a neutral position;

a second exhaust gas passage branched from the first exhaust gas passage at a location above the water;

an exhaust valve installed in the second exhaust gas passage;

an exhaust valve actuator connected to the exhaust valve;

an engine speed detector detecting a speed of the engine; and a control unit controlling operation of the exhaust valve actuator to open the exhaust valve based on the detected engine speed when the reverse position is established.

4. The exhaust system according to claim 3, further including:

a shift actuator operating the shift mechanism to establish one from among the forward position, the reverse position and the neutral position.

5. The exhaust system according to claim 3, wherein the first exhaust gas passage is opened at a portion rearward of the propeller.

6. The exhaust system according to claim 3, wherein the control unit controls the exhaust valve actuator to increase an opening of the exhaust valve with increasing engine speed.

7. An exhaust system of an outboard motor mounted on a stem of a boat and having an internal combustion engine to power a propeller and a first exhaust gas passage discharging exhaust gas generated by the engine into water, comprising:

a shift mechanism establishing one from among a forward position, a reverse position and a neutral position;

a second exhaust gas passage branched from the first exhaust gas passage at a location above the water;

an exhaust valve installed in the second exhaust gas passage;

an exhaust valve actuator connected to the exhaust valve;

a throttle position sensor detecting an opening of a throttle valve installed at an air intake passage of the engine; and a control unit controlling operation of the exhaust valve actuator to open the exhaust valve based on the detected throttle valve opening when the reverse position is established.

8. The exhaust system according to claim 7, wherein the control unit controls the exhaust valve actuator to increase an opening of the exhaust valve with increasing throttle valve opening.

9. The exhaust system according to claim 7, further including:

a shift actuator operating the shift mechanism to establish one from among the forward position, the reverse position and the neutral position.

10. The exhaust system according to claim 7, wherein the first exhaust gas passage is opened at a portion rearward of the propeller.

11. An exhaust system of an outboard motor mounted on a stem of a boat and having an internal combustion engine to power a propeller and a first exhaust gas passage discharging exhaust gas generated by the engine into water, comprising:

a shift mechanism establishing one from among a forward position, a reverse position and a neutral position;

a second exhaust gas passage branched from the first exhaust gas passage at a location above the water;

an exhaust valve installed in the second exhaust gas passage;

an exhaust valve actuator connected to the exhaust valve;

a device for allowing an operator to input a required opening of a throttle valve installed at an air intake passage of the engine; and a control unit controlling operation of the exhaust valve actuator to open the exhaust valve based on the required throttle valve opening when the reverse position is established.

12. The exhaust system according to claim 11, wherein the control unit controls the exhaust valve actuator to increase an opening of the exhaust valve with increasing required throttle valve opening.

13. The exhaust system according to claim 11, further including:

a shift actuator operating the shift mechanism to establish one from among the forward position, the reverse position and the neutral position.

14. The exhaust system according to claim 11, wherein the first exhaust gas passage is opened at a portion rearward of the propeller.

* * * * *

UNITED STATES PATENT AND TRADEMARK OFFICE

CERTIFICATE OF CORRECTION

PATENT NO. : 7,195,528 B2
APPLICATION NO. : 11/210475
DATED : March 27, 2007
INVENTOR(S) : Takada et al.

It is certified that error appears in the above-identified patent and that said Letters Patent is hereby corrected as shown below:

Under What is claimed is, column 12:

Claim 1, line 57, change “stem” to -- stern --

Under What is claimed is, column 13:

Claim 3, line 7, change “stem” to -- stern --

Claim 7, line 36, change “stem” to -- stern --

Under What is claimed is, column 14:

Claim 11, line 16, change “stem” to -- stern --

Signed and Sealed this

Nineteenth Day of June, 2007

JON W. DUDAS
*Director of the United States Patent and Trademark Office*